US006711871B2

(12) United States Patent
Beirise et al.

(10) Patent No.: US 6,711,871 B2
(45) Date of Patent: Mar. 30, 2004

(54) WALL PANEL WITH OFF-MODULE COMPONENTS

(75) Inventors: Jean M. Beirise, Cincinnati, OH (US); Kevin L. McClintock, Woodstock, GA (US); Todd A. Shane, Marietta, GA (US)

(73) Assignee: Herman Miller, Inc., Zeeland, MI (US)

( * ) Notice: Subject to any disclaimer, the term of this patent is extended or adjusted under 35 U.S.C. 154(b) by 88 days.

(21) Appl. No.: 09/843,372

(22) Filed: Apr. 26, 2001

(65) Prior Publication Data

US 2001/0039774 A1 Nov. 15, 2001

Related U.S. Application Data

(60) Provisional application No. 60/201,473, filed on May 3, 2000.

(51) Int. Cl.[7] ..... E04C 2/00

(52) U.S. Cl. ..... 52/782.1; 52/36.4; 52/36.5; 52/36.6; 52/246; 52/249; 52/245; 248/220.22; 248/220.21; 248/304; 211/82.01; 211/94.01

(58) Field of Search ..... 52/36.4, 36.5, 52/36.6, 246, 249, 245; 248/220.22, 220.01, 304; 211/87.01, 94.01

(56) References Cited

U.S. PATENT DOCUMENTS

| | | | | |
|---|---|---|---|---|
| 1,176,692 | A | 3/1916 | Smith | |
| 1,854,314 | A | 4/1932 | Ryan | |
| 1,981,240 | A | 11/1934 | McNeil | |
| 2,114,388 | A | 4/1938 | Killion | |
| 2,187,408 | A | 1/1940 | Thumm | |
| 2,499,240 | A | 2/1950 | Aiken | 35/63 |
| 2,969,565 | A | 1/1961 | Levy | |
| 3,195,698 | A | 7/1965 | Codrea | 189/34 |
| 3,255,563 | A | 6/1966 | Sauer | 52/404 |
| 3,316,624 | A | 5/1967 | Brudevold | 29/400 |
| 3,377,756 | A | 4/1968 | Polhamus | 52/220 |
| 3,412,515 | A | 11/1968 | Finon | 52/480 |
| 3,428,108 | A | 2/1969 | Singer | 160/135 |
| 3,461,349 | A | 8/1969 | Meyer | 317/120 |
| 3,462,892 | A | 8/1969 | Meyer | 52/28 |
| 3,553,916 | A | 1/1971 | Lickliter et al. | 52/281 |
| 3,567,842 | A | 3/1971 | Meyer | 174/48 |
| 3,585,768 | A | 6/1971 | Klein | 52/731 |

(List continued on next page.)

FOREIGN PATENT DOCUMENTS

| | | |
|---|---|---|
| CA | 2075014 | 7/1992 |
| CH | 680980 | 12/1989 |

OTHER PUBLICATIONS

"Ethospace Decision Book", E 1425 Rail Tile (Sep. 2, 1986).

"Ethospace Interiors", Herman Miller Inc., pp. 84–100, 109, 174–176, 201–216, 221–225, 286–292 (1995).

*Primary Examiner*—Carl D. Friedman
*Assistant Examiner*—Steve Varner
(74) *Attorney, Agent, or Firm*—Brinks Hofer Gilson & Lione

(57) ABSTRACT

A wall panel assembly comprising a curved, upwardly opening channel and a support member having a downwardly extending insert portion. The insert portion is inserted into the channel. A component is attached to the support member. In a preferred embodiment, a rail member comprises the channel and is removeably attached to a wall panel frame. In another aspect, the wall panel further includes at least a second channel and a second support member engaged with the second channel. The second support member being further attached to the component. In a preferred embodiment, one or both of the second support members include a rotatable cam member that releasably engages the component. A method is also provided for configuring a wall panel with an off-module component.

28 Claims, 17 Drawing Sheets

U.S. PATENT DOCUMENTS

| | | | | | |
|---|---|---|---|---|---|
| 3,592,289 | A | | 7/1971 | Aysta et al. | 181/30 |
| RE27,215 | E | | 11/1971 | Propst et al. | 52/36 |
| 3,675,382 | A | | 7/1972 | Lickliter et al. | 52/214 |
| 3,686,805 | A | | 8/1972 | Pofferi | 52/64 |
| 3,749,432 | A | | 7/1973 | Janssen | 287/189.36 A |
| 3,802,146 | A | | 4/1974 | Tacke et al. | 52/624 |
| 3,814,833 | A | | 6/1974 | Yamada et al. | 174/48 |
| 3,823,251 | A | | 7/1974 | Heithecker et al. | 174/48 |
| 3,831,330 | A | | 8/1974 | Tacke et al. | 52/220 |
| 3,834,093 | A | | 9/1974 | Tacke et al. | 52/71 |
| 3,835,602 | A | * | 9/1974 | Tuuri | 52/82 |
| 3,856,981 | A | | 12/1974 | Boundy | 174/48 |
| 3,862,524 | A | | 1/1975 | McCrackin | 52/36 |
| 3,909,502 | A | | 9/1975 | Lacan | 174/48 |
| 3,916,972 | A | | 11/1975 | Breiner | 160/135 |
| 4,032,821 | A | | 6/1977 | Keiser | 361/334 |
| 4,047,342 | A | | 9/1977 | Boulva | 52/239 |
| 4,055,922 | A | * | 11/1977 | Ellington et al. | 52/169.7 |
| 4,056,297 | A | | 11/1977 | Gartung | 339/23 |
| 4,057,123 | A | | 11/1977 | Erickson | 181/286 |
| 4,164,618 | A | | 8/1979 | Casasanta | 174/48 |
| 4,180,298 | A | | 12/1979 | Borgerson, Jr. | 312/242 |
| 4,197,685 | A | | 4/1980 | Goulish et al. | 52/239 |
| 4,200,254 | A | | 4/1980 | Nelson | 248/188.8 |
| 4,203,639 | A | | 5/1980 | VandenHoek et al. | 339/22 |
| 4,218,579 | A | | 8/1980 | Joly | 174/48 |
| 4,224,769 | A | | 9/1980 | Ball et al. | 52/36 |
| 4,229,917 | A | | 10/1980 | Textoris et al. | 52/239 |
| 4,255,611 | A | | 3/1981 | Propst et al. | 174/48 |
| 4,257,203 | A | | 3/1981 | Propst et al. | 52/221 |
| 4,269,005 | A | | 5/1981 | Timmons | 52/36 |
| 4,278,834 | A | | 7/1981 | Boundy | 174/48 |
| 4,284,840 | A | | 8/1981 | Baker | 174/48 |
| 4,353,411 | A | | 10/1982 | Harter et al. | 165/48 |
| 4,370,008 | A | | 1/1983 | Haworth et al. | 339/4 |
| 4,375,010 | A | | 2/1983 | Mollenkopf | 174/48 |
| 4,377,724 | A | | 3/1983 | Wilson | 174/48 |
| 4,391,073 | A | | 7/1983 | Mollenkopf et al. | 52/241 |
| 4,404,776 | A | | 9/1983 | Ball et al. | 52/29 |
| 4,443,986 | A | | 4/1984 | Propst et al. | 52/239 |
| 4,448,003 | A | | 5/1984 | Hasbrouck | 52/239 |
| 4,457,117 | A | | 7/1984 | Leiher et al. | 52/238.1 |
| 4,477,128 | A | | 10/1984 | Hasbrouck | 312/111 |
| 4,516,619 | A | | 5/1985 | Hasbrouck | 160/135 |
| 4,535,577 | A | | 8/1985 | Tenser et al. | 52/221 |
| 4,567,698 | A | | 2/1986 | Morrison | 52/36 |
| 4,571,907 | A | | 2/1986 | DeFouw et al. | 52/239 |
| 4,601,137 | A | | 7/1986 | Bates | 52/63 |
| 4,601,145 | A | | 7/1986 | Wilcox | 52/238.1 |
| 4,618,192 | A | | 10/1986 | Kelley | 312/245 |
| 4,619,486 | A | | 10/1986 | Hannah et al. | 312/195 |
| 4,625,483 | A | | 12/1986 | Zacky et al. | 52/239 |
| 4,629,076 | A | | 12/1986 | Amstutz et al. | 211/94 |
| 4,631,881 | A | | 12/1986 | Charman | 52/220 |
| 4,642,418 | A | | 2/1987 | Menchetti | 174/48 |
| 4,685,255 | A | | 8/1987 | Kelley | 52/36 |
| 4,712,336 | A | | 12/1987 | Backer | 52/71 |
| 4,716,698 | A | | 1/1988 | Wilson et al. | 52/239 |
| 4,718,627 | A | | 1/1988 | Fast et al. | 248/225.1 |
| 4,771,583 | A | | 9/1988 | Ball et al. | 52/221 |
| 4,802,422 | A | | 2/1989 | Beard | 108/64 |
| 4,805,784 | A | | 2/1989 | Solheim et al. | 211/94 |
| RE32,890 | E | | 3/1989 | DeFouw et al. | 52/239 |
| 4,821,477 | A | | 4/1989 | Rydqvist | 52/239 |
| 4,831,791 | A | | 5/1989 | Ball | 52/36 |
| 4,833,848 | A | | 5/1989 | Guerin | 52/242 |
| 4,843,977 | A | | 7/1989 | Bridges | 108/152 |
| 4,874,027 | A | | 10/1989 | Boundy et al. | 160/230 |
| 4,876,835 | A | | 10/1989 | Kelley et al. | 52/239 |
| 4,881,349 | A | | 11/1989 | Brown et al. | 52/127.11 |
| 4,881,352 | A | | 11/1989 | Glockenstein | 52/239 |
| 4,882,885 | A | | 11/1989 | Chatterson et al. | 52/221 |
| 4,891,920 | A | | 1/1990 | Pingston | 52/145 |
| 4,899,018 | A | | 2/1990 | Sireci | 174/48 |
| 4,914,873 | A | | 4/1990 | Newhouse | 52/36 |
| 4,931,597 | A | | 6/1990 | Kimbrough et al. | 174/48 |
| 4,932,177 | A | | 6/1990 | Hinden | 52/221 |
| 4,936,066 | A | | 6/1990 | Rütsche et al. | 52/238.1 |
| 4,962,805 | A | | 10/1990 | Allen | 160/135 |
| 4,996,811 | A | | 3/1991 | Dull et al. | 52/241 |
| 5,004,371 | A | | 4/1991 | Sorensen | 403/327 |
| 5,013,112 | A | | 5/1991 | Hellwig | 350/96.1 |
| 5,024,030 | A | | 6/1991 | Morrison | 52/36 |
| 5,038,539 | A | | 8/1991 | Kelley et al. | 52/239 |
| 5,056,577 | A | | 10/1991 | DeLong et al. | 160/135 |
| 5,058,331 | A | | 10/1991 | Epps | 52/36 |
| 5,058,347 | A | | 10/1991 | Schuelke et al. | 52/339 |
| 5,062,246 | A | | 11/1991 | Sykes | 52/126.4 |
| 5,065,556 | A | | 11/1991 | DeLong et al. | 52/221 |
| 5,069,263 | A | | 12/1991 | Edwards | 160/135 |
| 5,081,808 | A | | 1/1992 | Bastian et al. | 52/220 |
| 5,094,053 | A | | 3/1992 | Militzer | 52/238.1 |
| 5,101,606 | A | | 4/1992 | Meru | 52/282 |
| 5,110,080 | A | | 5/1992 | Reiman | 248/225.1 |
| 5,116,235 | A | | 5/1992 | Nienhuis et al. | 439/215 |
| 5,129,835 | A | | 7/1992 | DeFouw et al. | 439/215 |
| 5,134,826 | A | | 8/1992 | La Rouche et al. | 52/584 |
| 5,155,955 | A | | 10/1992 | Ball et al. | 52/126.4 |
| 5,155,960 | A | | 10/1992 | Shaanan | 52/584 |
| 5,172,529 | A | | 12/1992 | Van De Riet | 52/221 |
| 5,175,969 | A | | 1/1993 | Knauf et al. | 52/239 |
| 5,187,912 | A | | 2/1993 | Hsueh | 52/584 |
| 5,195,286 | A | | 3/1993 | DeLong et al. | 52/220 |
| 5,195,287 | A | | 3/1993 | Bruggink | 52/221 |
| 5,207,041 | A | | 5/1993 | Wills | 52/220 |
| 5,209,035 | A | | 5/1993 | Hodges et al. | 52/220.7 |
| 5,211,502 | A | | 5/1993 | Upham-Hill | 403/353 |
| 5,214,889 | A | | 6/1993 | Nienhuis et al. | 52/220.7 |
| 5,214,890 | A | | 6/1993 | Levitan et al. | 52/220.7 |
| 5,216,859 | A | | 6/1993 | Moreno et al. | 52/238.1 |
| 5,224,673 | A | | 7/1993 | Webb | 248/27.1 |
| 5,228,254 | A | | 7/1993 | Honeycutt, Jr. | 52/241 |
| 5,241,796 | A | | 9/1993 | Hellwig et al. | 52/36.4 |
| 5,251,413 | A | | 10/1993 | Goodman | 52/239 |
| 5,274,970 | A | | 1/1994 | Roberts | 52/126.2 |
| 5,277,005 | A | | 1/1994 | Hellwig et al. | 52/220.7 |
| 5,277,006 | A | | 1/1994 | Ruster | 52/220.7 |
| 5,277,007 | A | | 1/1994 | Hellwig et al. | 52/220.7 |
| 5,287,666 | A | | 2/1994 | Frascaroli et al. | 52/239 |
| 5,287,909 | A | | 2/1994 | King et al. | 160/135 |
| 5,309,686 | A | | 5/1994 | Underwood et al. | 52/29 |
| 5,326,934 | A | | 7/1994 | LeMaster et al. | 174/59 |
| 5,337,525 | A | | 8/1994 | Zaccai et al. | 52/35 |
| 5,341,615 | A | | 8/1994 | Hodges et al. | 52/220.7 |
| 5,347,778 | A | | 9/1994 | Bray | 52/239 |
| 5,357,055 | A | | 10/1994 | Sireci | 174/48 |
| 5,362,923 | A | | 11/1994 | Newhouse et al. | 174/48 |
| 5,363,612 | A | | 11/1994 | Erickson | 52/239 |
| 5,370,488 | A | | 12/1994 | Sykes | 411/551 |
| 5,381,994 | A | | 1/1995 | Welch | 248/346 |
| 5,394,658 | A | | 3/1995 | Schreiner et al. | 52/36.1 |
| 5,400,560 | A | | 3/1995 | Hellwig et al. | 52/578 |
| 5,403,232 | A | | 4/1995 | Helm et al. | 454/230 |
| 5,406,760 | A | | 4/1995 | Edwards | 52/239 |
| 5,409,120 | A | | 4/1995 | Miller et al. | 211/87 |
| 5,426,904 | A | | 6/1995 | Gilmore | 52/489.1 |
| 5,428,928 | A | | 7/1995 | Hellwig et al. | 52/239 |
| 5,465,541 | A | | 11/1995 | Lin et al. | 52/220.2 |
| 5,474,402 | A | | 12/1995 | Wu | 403/405.1 |
| 5,479,747 | A | | 1/1996 | Wu | 52/220.7 |
| 5,487,246 | A | | 1/1996 | Hodges et al. | 52/220.7 |

5,490,357 A 2/1996 Lin ..... 52/220.7
5,502,930 A 4/1996 Burkette et al. ..... 52/71
5,560,418 A 10/1996 Kissinger ..... 160/351
5,561,960 A 10/1996 Minnick et al. ..... 52/578
5,582,376 A 12/1996 Thompson ..... 248/214
5,740,650 A 4/1998 Sieber et al. ..... 52/584.1
5,746,034 A 5/1998 Luchetti et al. ..... 52/220.7
5,746,035 A 5/1998 Seiber et al. ..... 52/238.1
5,775,521 A 7/1998 Tisbo ..... 211/94.1
5,806,258 A 9/1998 Miedema et al. ..... 52/220.7
5,816,001 A 10/1998 Goodman et al. ..... 52/239
5,819,490 A 10/1998 Current ..... 52/588.1
5,852,904 A 12/1998 Yu et al. ..... 52/220.7
5,875,596 A 3/1999 Muller ..... 52/239
5,875,901 A 3/1999 Morrow et al. ..... 211/59.1
5,890,325 A 4/1999 Corcorran et al. ..... 52/36.1
5,894,940 A 4/1999 Gusdorf et al. ..... 211/35
6,000,179 A 12/1999 Musculus et al. ..... 52/239
6,047,508 A 4/2000 Goodman et al. ..... 52/241
6,167,664 B1 * 1/2001 Reuter et al. ..... 52/239

* cited by examiner

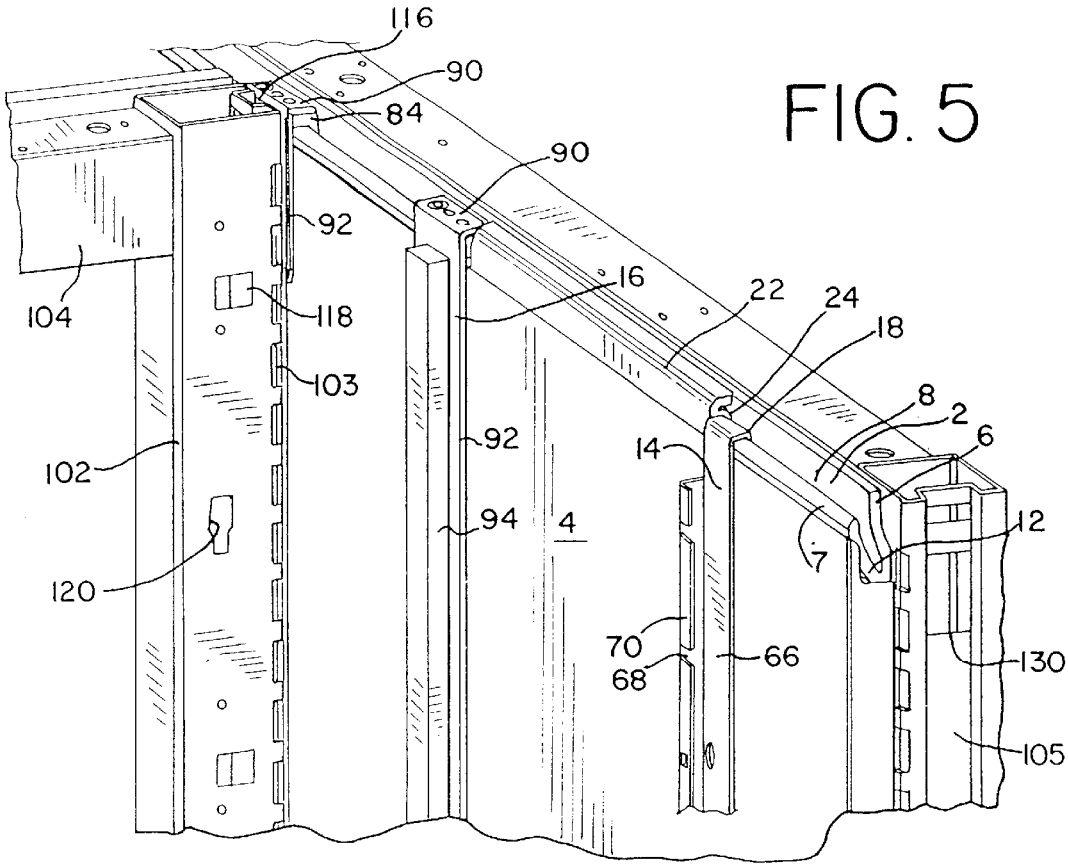
FIG. 5
FIG. 6
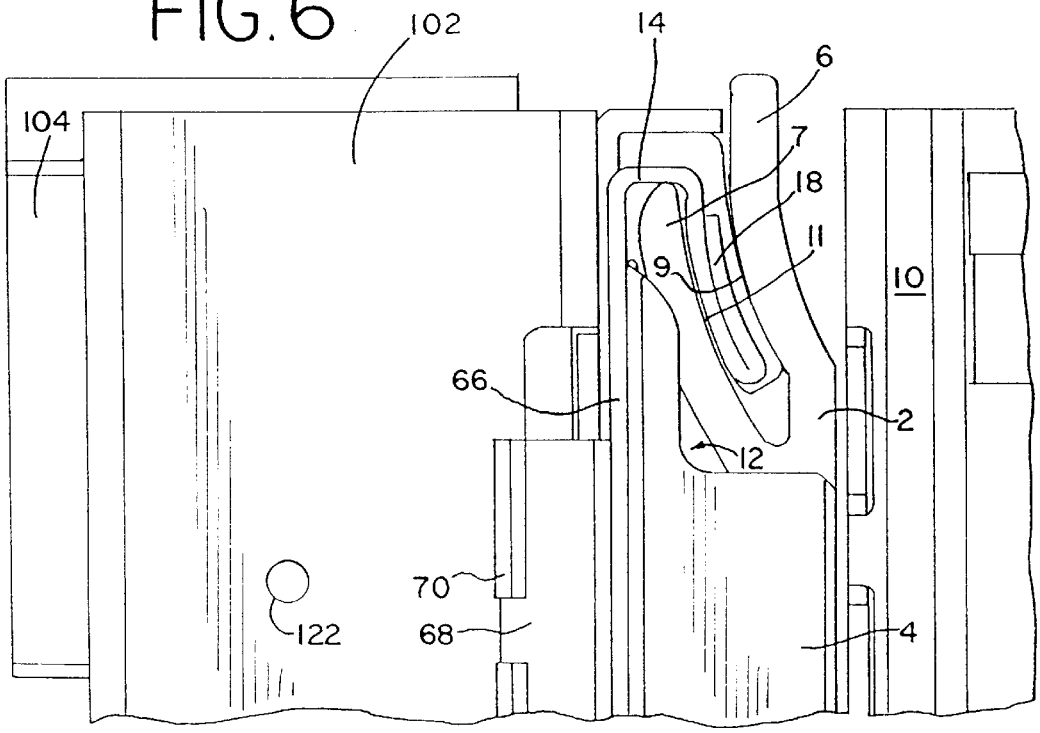

WALL PANEL WITH OFF-MODULE COMPONENTS

CROSS-REFERENCE TO RELATED APPLICATIONS

This application claims the benefit of U.S. Provisional Application No. 60/201,473, filed May 3, 2000, which application is hereby incorporated herein by reference.

BACKGROUND

The present invention relates generally to a wall panel system, and in particular, to a wall panel comprising an off-module component disposed thereon.

Panel systems are commonly used to divide large, open office space into separate workspaces. For example, Herman Miller, Inc., the assignee of the present application, manufacturers and sells at least two such work space management systems: the ACTION OFFICE® system and the ETHOSPACE® system. Typically, workspace management systems are comprised of a series of wall panels arranged in various configurations. For example, wall panels can be connected in series in an end-to-end configuration, or they can be arranged around and connected to a corner post in a two-way, three-way or four-way configuration.

Typically, office system components, such as return panels, overhead cabinets, work surfaces, shelving and the like, are supported at the junction of adjoining wall panels, whether by way of direct connection to the ends of one or more of the adjoining wall panels, or by way of connection to a corner post or other connector positioned therebetween. As such, the position of the components is predetermined, based upon the modular length of the wall panels incorporated into the system.

However, wall panels also can be configured to support various office system components "off-module," meaning that the various office system components, e.g., return panels and the like, can be connected to the wall panel at various points along the length of the wall panel between the ends thereof. Typically, however, such wall panels include elaborate, complex infrastructures that can be expensive to manufacture. In addition, such wall panels typically have points of attachment vertically fixed along the height of the panel, thereby limiting vertical reconfigurability of the components. Moreover, such systems typically require at least two points of attachment to prevent the inadvertent dislodgment of the components from the wall panel.

SUMMARY

Briefly stated, one aspect of the invention is directed to an improved wall panel assembly comprising first and second upwardly extending, curvilinear walls, which are spaced apart to form an upwardly opening channel. A support member includes a downwardly extending, curvilinear insert portion, which is dimensioned to be received in the channel. The insert portion is inserted into the channel, and a component is attached to the support member. In a preferred embodiment, a rail member defines the channel and is attached to a wall panel frame. The rail is preferably removably attached to the wall on one or both sides thereof.

In one embodiment of the invention, the only connection between the component and the wall panel is the interface between the insert portion of the support member and the channel. In one preferred embodiment, the insert portion and the channel include opposing channels that form a passage therebetween. A pin can be inserted in the passageway so as to prevent dislodgment of the insert portion from the channel.

In another aspect of the invention, the wall panel comprises a downwardly extending wall having a bottom edge and an upwardly extending wall having a top edge. The downwardly extending wall is disposed above the upwardly extending wall, with the bottom and top edges respectively of the downwardly and upwardly extending walls spaced apart to form an opening therebetween. A second support member includes an insert portion that abuttingly engages at least one of the downwardly and upwardly extending walls. The component is attached to the first support member engaging the channel, and is further attached to the second support member. In a preferred embodiment, a connector tile comprises the downwardly and upwardly extending walls and is attached to a wall panel frame.

In yet another aspect of the invention, the wall panel assembly comprises an elongated, horizontally oriented channel. A support member engages the channel, and can be moved to any position along the length of the channel.

In yet another aspect, the support member comprises a rotatable cam member that is rotatable between an engaged position and a disengaged position. The cam member is inserted into an opening in the component when in the disengaged position and is thereafter rotated to the engaged position so as to engage the component.

In yet another aspect of the invention, a method for reconfiguring a wall panel with an off-module component is provided. The method includes providing a panel having a first and second side and attaching a rail member to the first side of the wall panel. The rail member comprises a curved, upwardly opening channel. The method further includes providing a support member having a downwardly extending, curved insert portion. The insert portion is inserted into the channel and a component is supported on the support member.

In another aspect, the method further comprises disconnecting the support member by removing the insert portion from the channel and detaching the rail from the wall panel.

The present invention provides significant advantages over other wall panel assemblies. For example, the interface between the insert portion of the support member and the curved channel of the wall panel can help prevent the support member from being inadvertently dislodged from the wall panel, especially when configured with an antidislodgment pin. As such, various components, such as an overhead cabinet, can be connected to the wall panel at a single location, without the need for additional antidislodgment clips and the like.

At the same time, the component can be further connected to a second support member engaged with a pair of walls forming an opening therebetween. The support members can be easily moved to any position along the length of the wall panel to provide off-module support for various office system or work station components.

In addition, the rail member, which is preferably removably attached to a frame of the wall panel, can be easily attached to the frame as needed to support various off-module components. At the same time, the rail member can be easily removed if no components are to be attached off-module. As such, the user can use the rail member as needed, thereby reducing the inventory of parts and the overall expense of the system.

Likewise, the connector tile, which also is preferably removeable, can be easily attached or removed as needed. In addition, both the rail member and connector tile can be attached to the wall panel at any vertical location, thereby providing a variety of vertical support positions for the various office system components.

The present invention, together with further objects and advantages, will be best understood by reference to the following detailed description taken in conjunction with the accompanying drawings.

BRIEF DESCRIPTION OF THE DRAWINGS

FIG. 5 is a perspective view a wall panel with a plurality of support members supported on a rail member, a tile member, and a return panel connected to one of the support members.

FIG. 6 is a partial end view of the assembly shown in FIG. 5.

DETAILED DESCRIPTION OF THE PRESENTLY PREFERRED EMBODIMENTS

Figure 18:
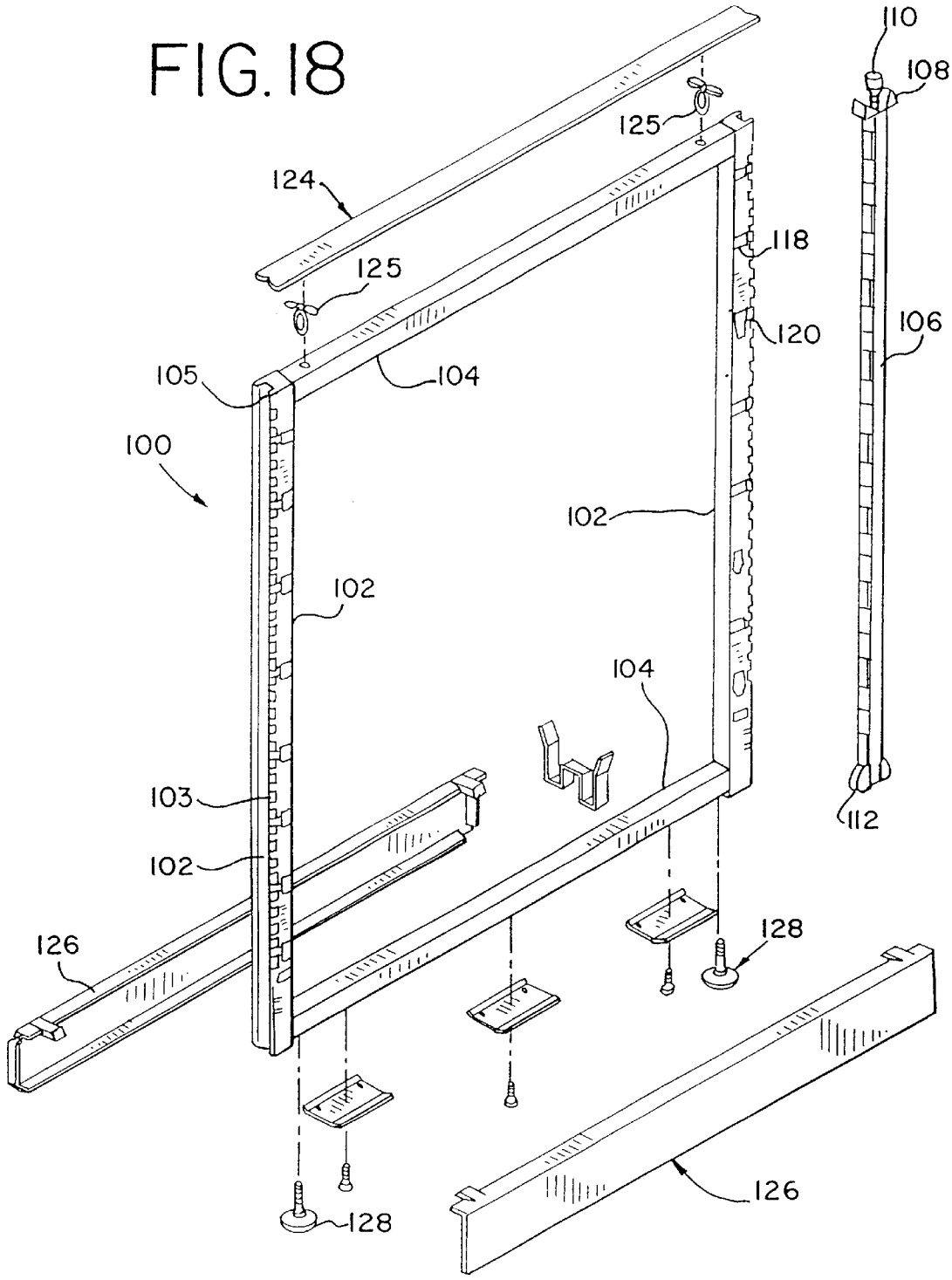
FIG. 18 is an exploded perspective view of a wall panel frame and connector system.
Figure 19:
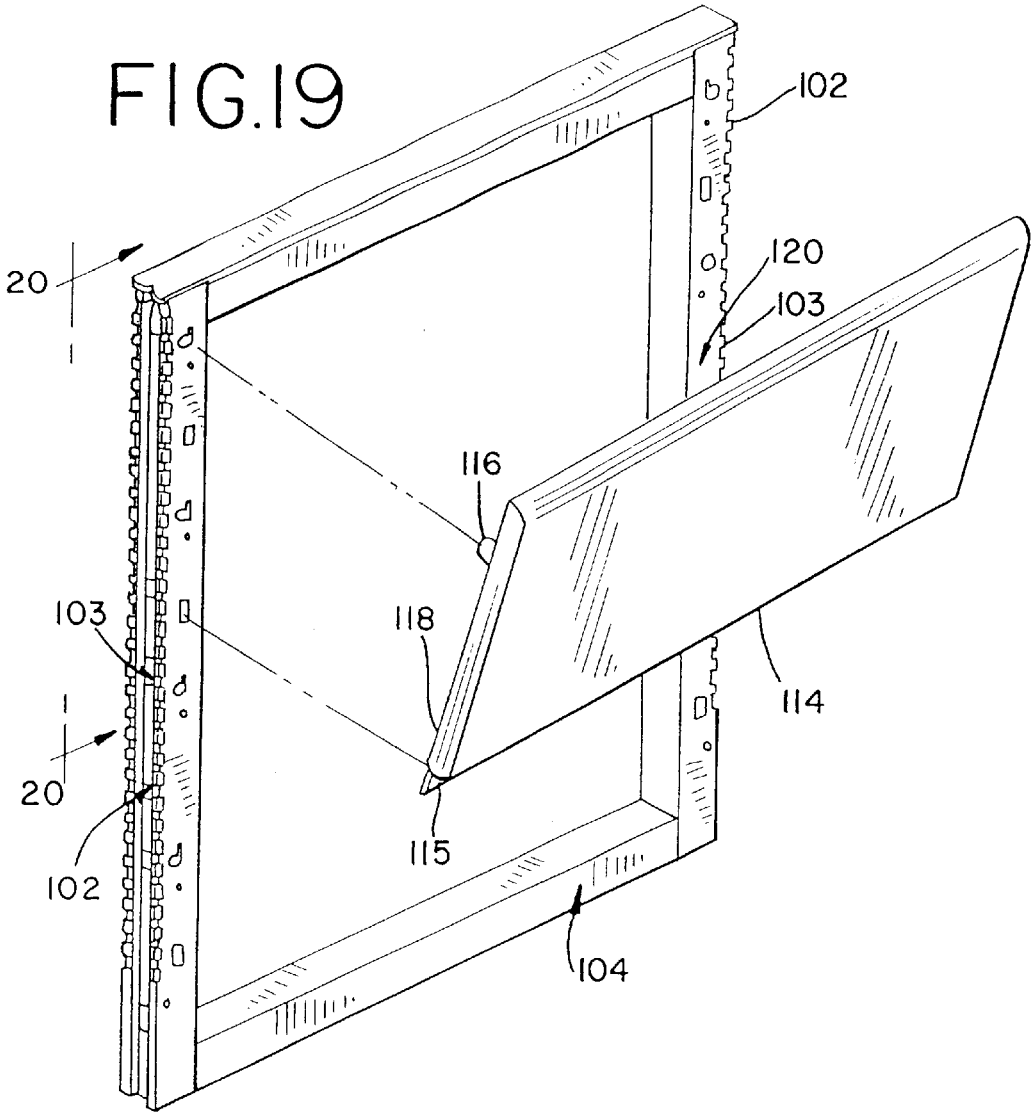
FIG. 19 is an exploded perspective view of a cover tile being installed on a wall panel frame.
Figure 20:
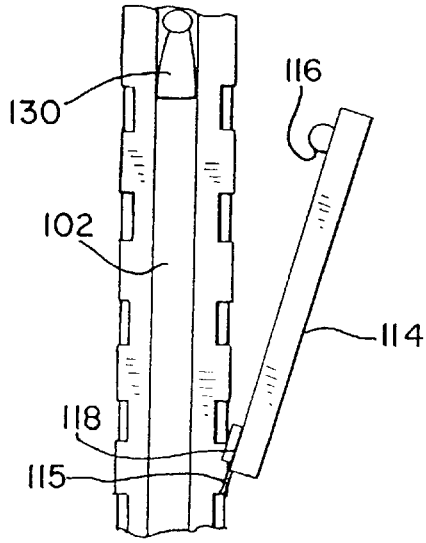
FIG. 20 is a partial side view of the cover tile and wall panel frame shown in FIG. 19.

Referring to the drawings, FIG. 18 shows a wall panel frame 100. The frame 100 comprises a pair of vertical frame members 102 and an upper and lower horizontal frame member 104. The horizontal frame members 104 abut the vertical frame members 102 and are preferably affixed thereto at the corners of the panel by welding. It should be understood that the frame members could also be affixed by way of fasteners, adhesives and the like. The vertical frame members 102 have a slightly larger width than the horizontal frame members 104, and further include an outwardly facing channel 105 formed along the length thereof on each end of the wall panel. The vertical frame members have a plurality of openings 103, or slots, formed along their respective lengths at the opposite ends of the panel. The openings 103 are shaped and oriented to engage brackets, which support various work station components. As shown in FIGS. 3, 9, 18 and 27, the vertical frame members 102 further include a plurality of vertically disposed alternating rectangular openings 118 and tapered keyhole slots 120, which are positioned on the frame members inboard of the openings 103. The vertical frame members 102 further include a plurality of circular fastener openings 122 vertically disposed therealong.

As best shown in FIGS. 9, 19, 20 and 27 cover tiles 114 span between and are removeably attached to the vertical frame members 102 with hooks 118 and spring clips 116 that engage the frame members at openings 118, 120. The cover tiles 114 do not span the entire length of the wall panel, but fall short to expose the openings 103 on the vertical frame members such that various components can be engaged thereon. The cover tiles 114 can be covered with a covering such as a fabric, can comprise a tackable surface, or can be made of metal, wood, plastic, glass or any other suitable material. The cover tiles 114 further preferably include a trim portion 115 extending from the bottom of the cover tile, which spans the gap between the bottom of the cover tile and the top of the next lower tile. The trim portion is preferably vinyl.

Alternatively, a rail tile can be removeably attached to the frame in place of the cover tile. The rail tile includes a plurality of horizontally oriented channels disposed one above the other. Various office system components, such as paper trays and the like, include a hook member that is engaged with at least one of the channels on the rail tile. The back of the member abuttingly engages the outermost face of the rail tile for stability.

As shown in FIG. 18, the wall panel further includes a top cap 124 that is snap fitted to the upper horizontal frame member with a pair of clips. A pair of base covers 126 are connected to opposite sides of a lower portion of the frame. A pair of support feet 128 engage the floor and support the frame thereabove.

Serially-adjacent wall panels are connected one to the other with a draw tube assembly 106 shown in FIG. 18. In particular, the draw tube 106 is disposed in the space formed by the channels 105 of abutting, adjacent vertical frame members 102. A draw block 108 extends into one of a series of openings 130 formed in the base of channel 105 and engage draw surfaces formed on a plate installed on top of the vertical frame members. A draw bolt 110 engages the draw block and draws the adjacent panels together. Wall panels connected at 90 degrees in two-way, three-way and four-way configurations further incorporate a corner post disposed between the various wall panel configurations. The wall panel frame, connector system and tiles are further shown and described in U.S. Pat. Nos. 4,571,907, 4,876,835 and 4,618,192, all of which are hereby incorporated herein by reference.

Figure 1:
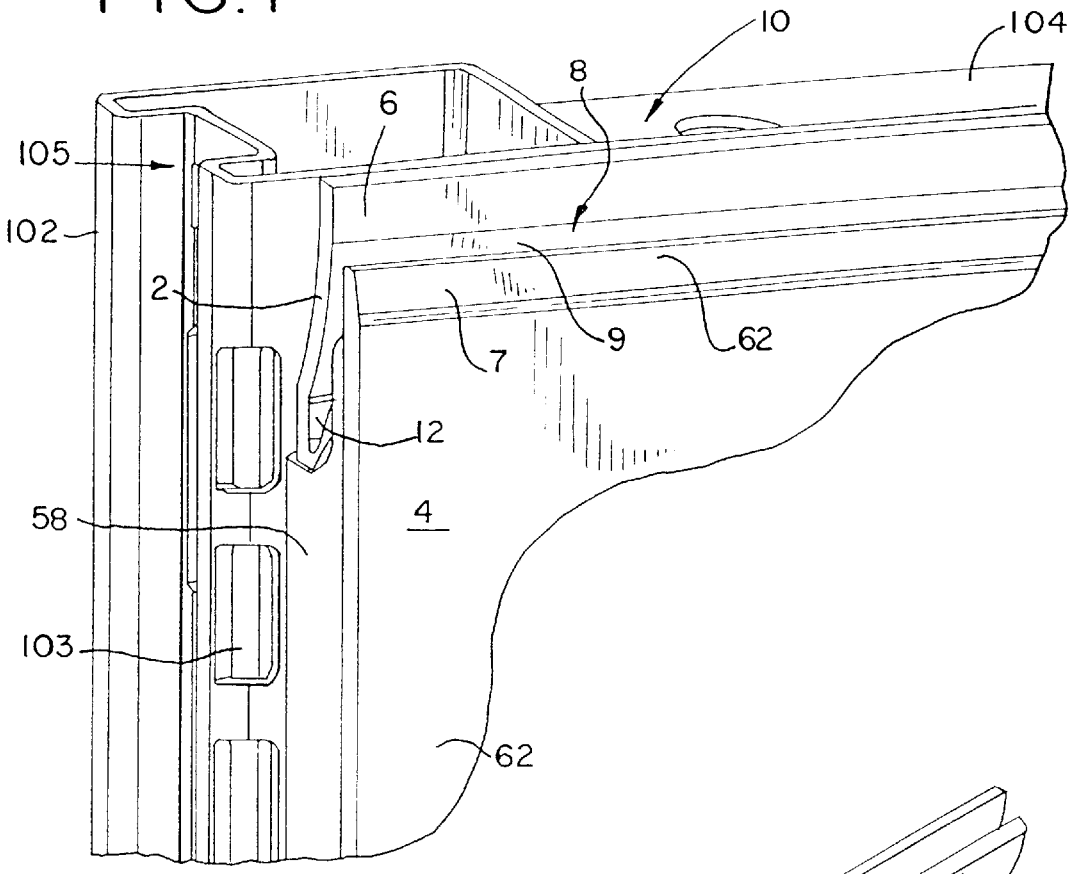
FIG. 1 is a partial perspective view of a wall panel frame with a rail member and tile connected thereto.
Figure 2:
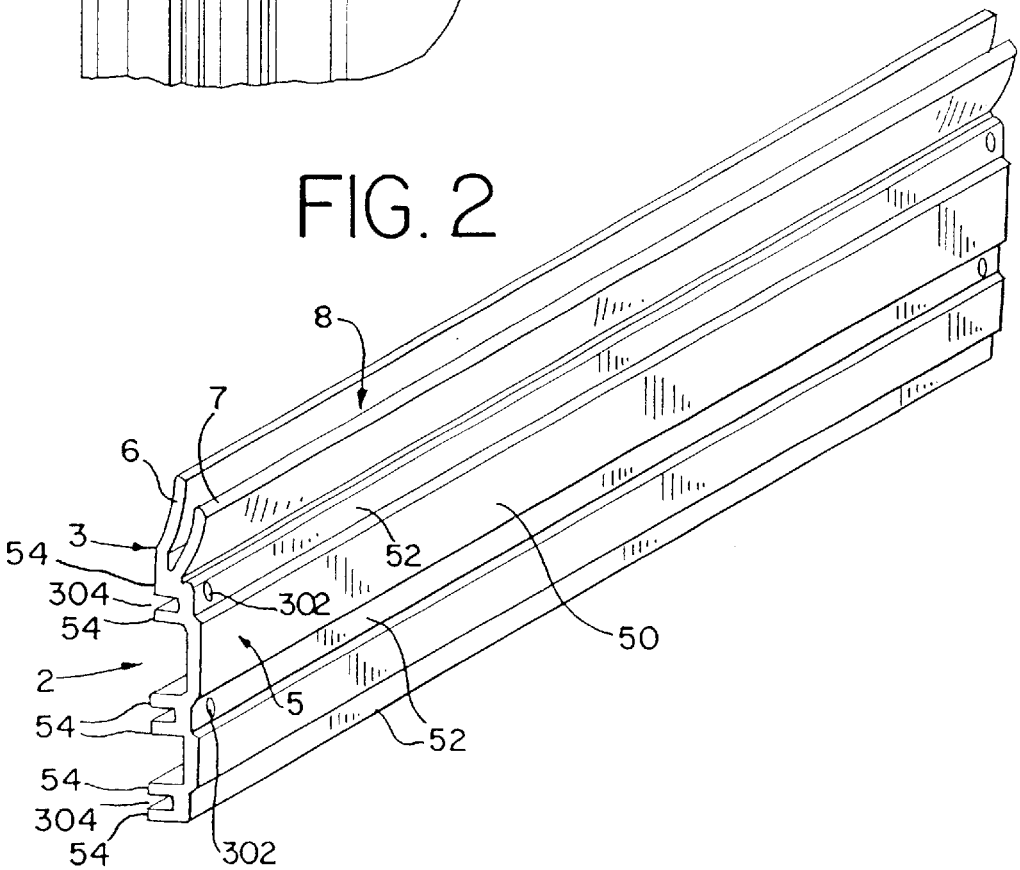
FIG. 2 is a perspective view of a rail member.
Figure 3:
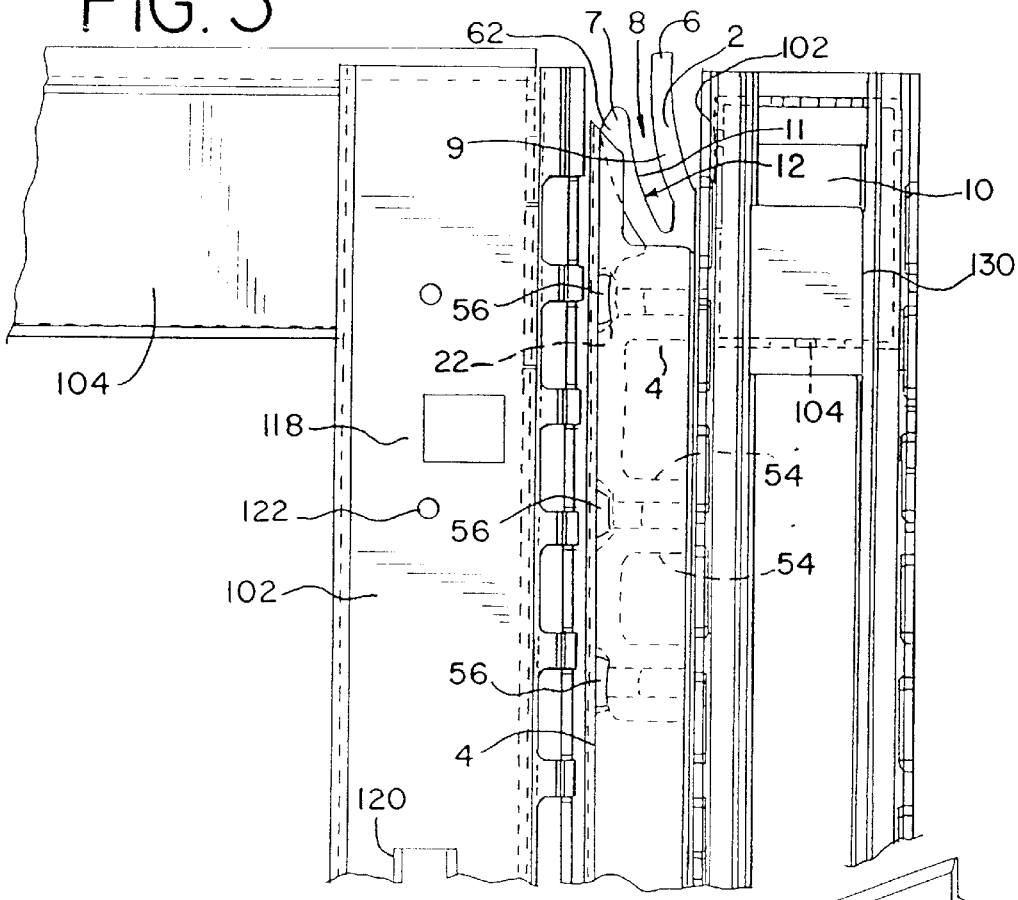
FIG. 3 is a partial side view of a return panel positioned adjacent to a wall panel with a rail member and a tile member attached thereto.
Figure 22:
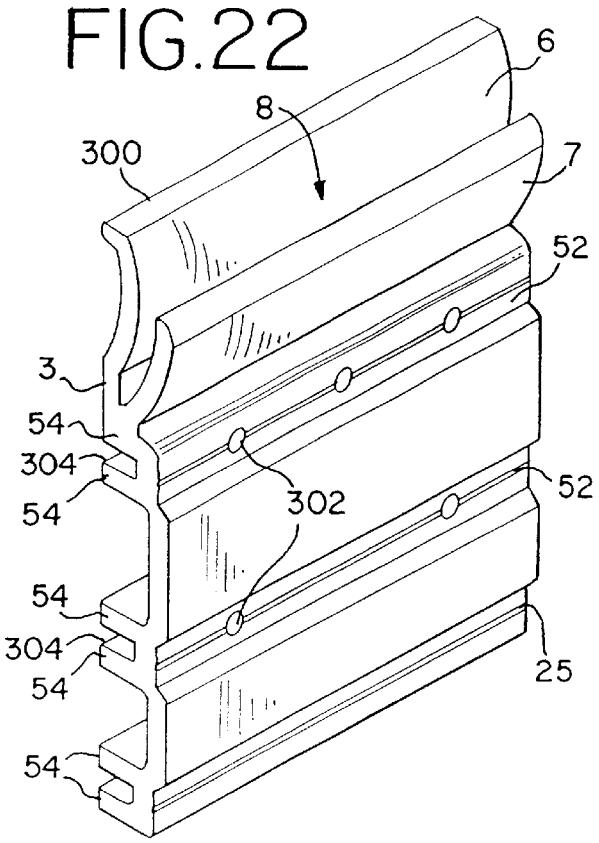
FIG. 22 is partial perspective view of an alternative embodiment of a rail member.

Now referring to FIGS. 1–3, a rail member 2 includes an upper portion 3 and a lower portion 5. The upper portion 3 includes an upwardly opening channel 8 formed by a first and second upwardly extending walls 6, 7. The upstanding walls 6, 7 of the rail member are curvilinear, and preferably arcuate, such that the channel 8 has a curved interior space formed between an inner concave surface 9 of the first wail and the inner convex surface 11 of the second wall. In an alternative embodiment, shown in FIG. 22, the first wall 6 has a return portion 300 of flange that extends laterally inward to close the gap between the wall and the top cap of the wall panel. The lower portion 5 of the rail member includes a vertically extending wall 50, with a plurality of horizontally extending recesses 52, one being formed as a groove, that are recessed laterally inward from the outermost surface of the vertical wall. A plurality of ribs 54 extend laterally from the wall opposite the recesses 52 so as to provide the rail member with increased strength. At the same time, a plurality of laterally extending openings 302 are centered in the recesses and communicate with a channel 304 formed by the ribs.

The ends of the rail 2 are attached to one side of the vertical frame members 102 making up the inner panel frame 100 with a plurality of fasteners, such that the channel 8 runs horizontally along a top edge of the wall panel. In this way, the rail member 2 can be removeably attached to the frame and can be removed or installed as needed. As shown in FIG. 3, The fastener heads 56 are received in the recessed grooves such that they do not interfere with any support components or the like which abut the outermost surface of the vertical wall. It should be understood that the rail member could also be attached to the horizontal frame member with fasteners, and that the rail member could be attached to any of the frame members with clips and the like. Alternatively, the rail member could be fixedly attached to the frame by welding and the like.

The upwardly opening channel 8 of the rail member runs substantially along the entire length of the wall panel, but terminates short of the ends of the frame so as to leave exposed the slots 103 formed in the vertical frame member 102. The inner, first wall 6 of the channel is longer than and has a greater upward extent than the outer, second wall 7. The channel 8 curves away from the frame as it extends upwardly. The concave interior surface 9 of the inner wall, faces outwardly from the panel frame, while the convex interior surface 11 of the outer wall faces inwardly toward the panel frame. The rail member is preferably metal and is preferably formed as an extrusion, although it should be understood that other materials and methods of forming would also work.

Figure 4:
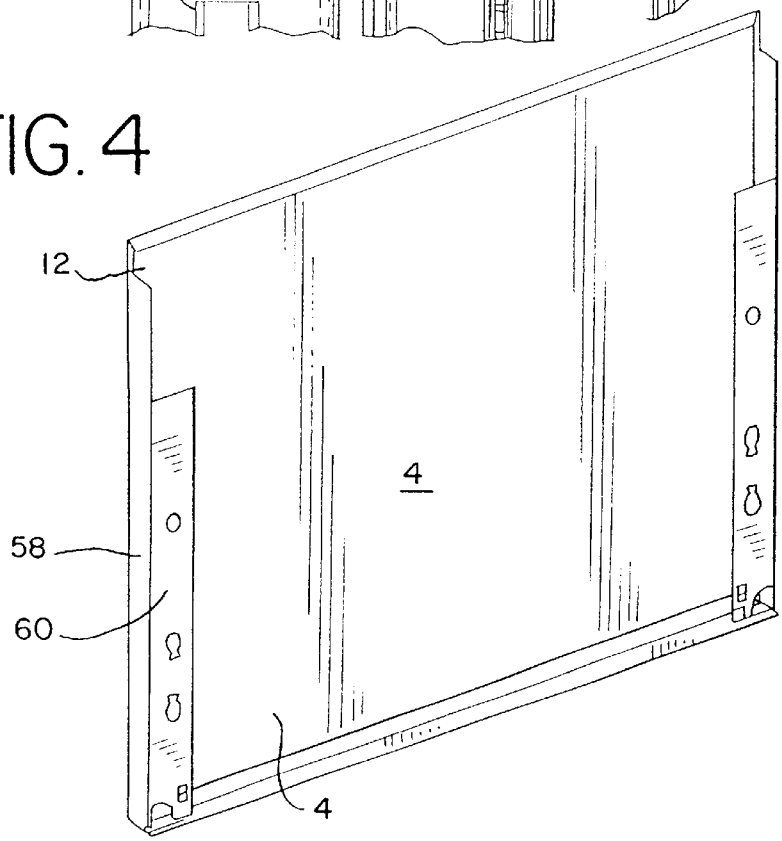
FIG. 4 is rear perspective view of a tile.
Figure 7:
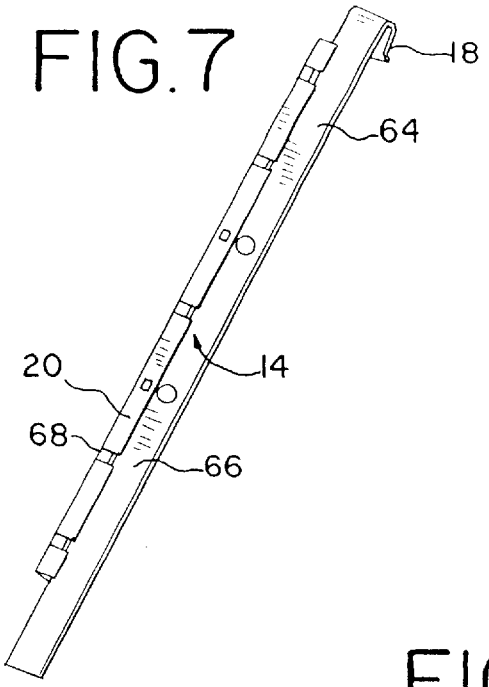
FIG. 7 is a perspective view of one embodiment of a support member.
Figure 21:
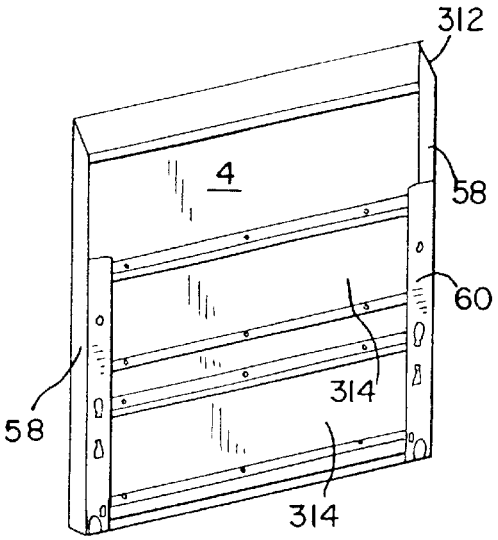
FIG. 21 is a rear perspective view of an alternative embodiment of a tile.

A cover tile 4, shown in FIGS. 1, 3 and 4, is positioned over the rail member 2 and is removeably attached to the vertical frame members with hooks and clips which are inserted in a pair of mounting flanges 60, as explained above. The cover tile has side portions 58 or webs that extend between the mounting flanges 60 and a flat outer face 62 of the cover tiles. Each side portion 58 has a cut-out 12 along a top portion thereof. As shown in FIGS. 1 and 3, the cut-out 12 is dimensioned to allow access to the ends of the channel 8 once the cover tile 4 is mounted to the frame such that various support members can be slid from one panel to the next, when serially aligned. The cut-out can be formed in a variety of different shapes. For example, the cut-out 12 is shown in FIG. 3 as being substantially rectangular, with the corners thereof being curved. Alternatively, as shown in FIG. 21, the corners of the side portions 58 can simply be cut at a diagonal to form a triangular shaped cut-out 312. Also in the embodiment of FIG. 21, a pair of hat-sections 314 are attached, preferably by welding, to the backside of the cover tile 4 to provide it with additional strength and rigidity.

When mounted to the frame, the cover tile 4 covers the lower portion 5 of the rail member, as shown in FIGS. 1, 3 and 5, and further covers substantially the entirety of the outer wall 7 such that only a lip 62 thereof is visible to the user. If the rail member is not needed for off-module support, it can be removed after the cover tile 4 is removed. A cover tile 114, with its closed upper end and sides, can then be removably attached in place of the cover tile 4.

Referring to FIGS. 5–7 and 14, a vertically extending, upper support member 14 includes an insert portion 18, preferably configured as a curved hook shaped to be received in the channel, and a vertical extending connector portion 64. The insert portion 18 is formed by folding a metal flange back on itself to increase the rigidity and strength thereof. The insert portion 18 preferably has a radius of curvature of about 1.25 inches. The insert portion 18 is inserted into the channel 8, such that the base portion 66 of the connector portion abuts the surface of the outer tile face. The interface between the curved insert portion 18 and the curved channel 8 prevents unintended dislodgment of the support member and of any components supported thereon.

Figure 31:
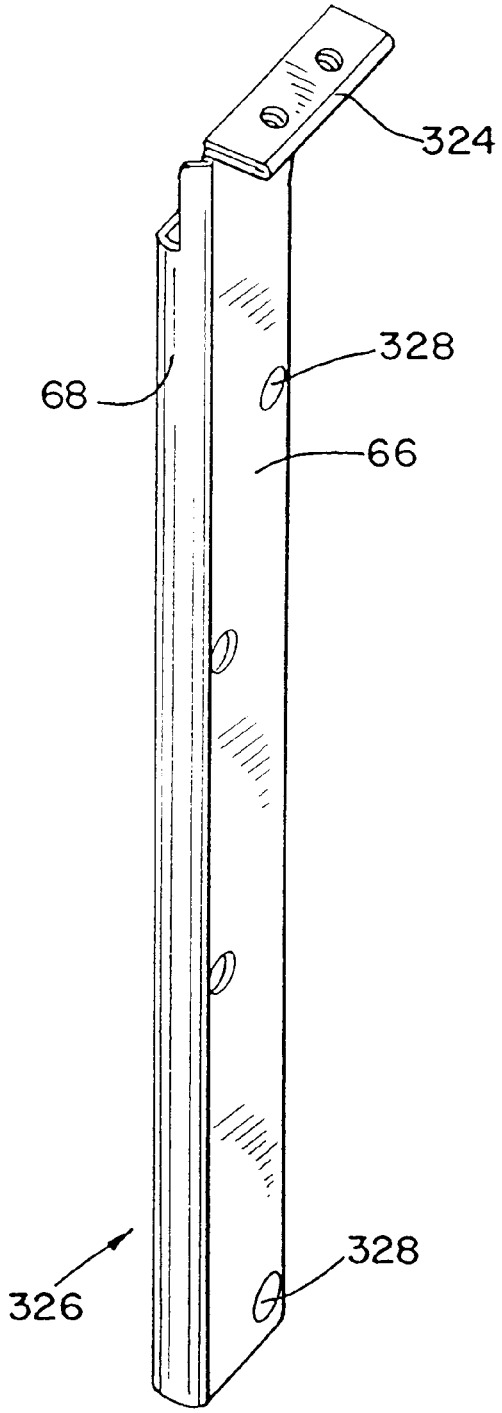
FIG. 31 is a perspective view of an alternative embodiment of a connector member.
Figure 32:
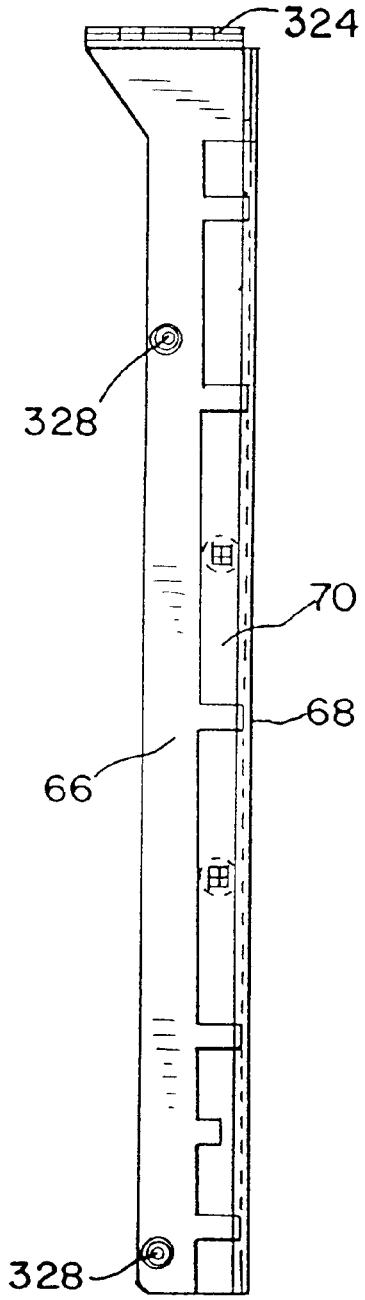
FIG. 32 is a front view of the connector member shown in FIG. 31.
Figure 34:
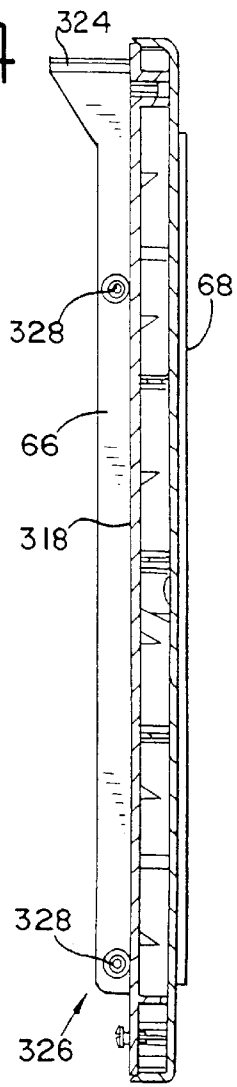
FIG. 34 is a sectional view of the end panel taken along line 34—34 in FIG. 33.
Figure 36:
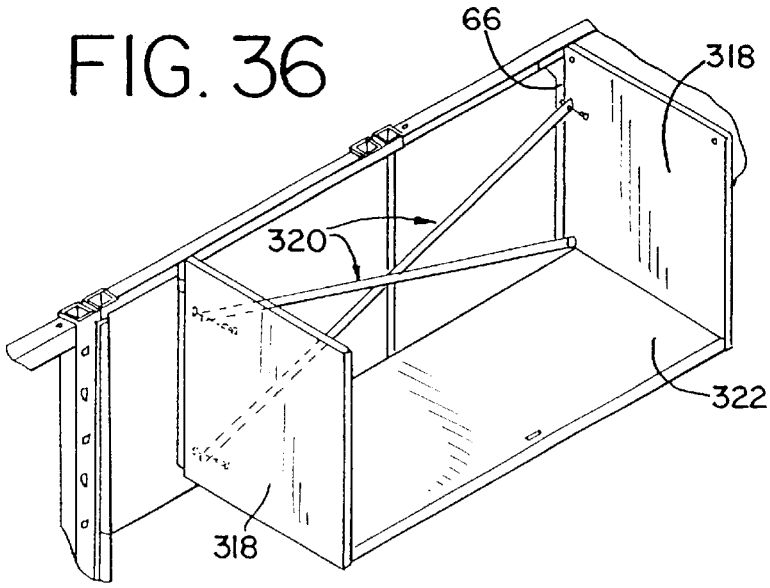
FIG. 36 is a perspective view of an overhead assembly.
Figure 38:
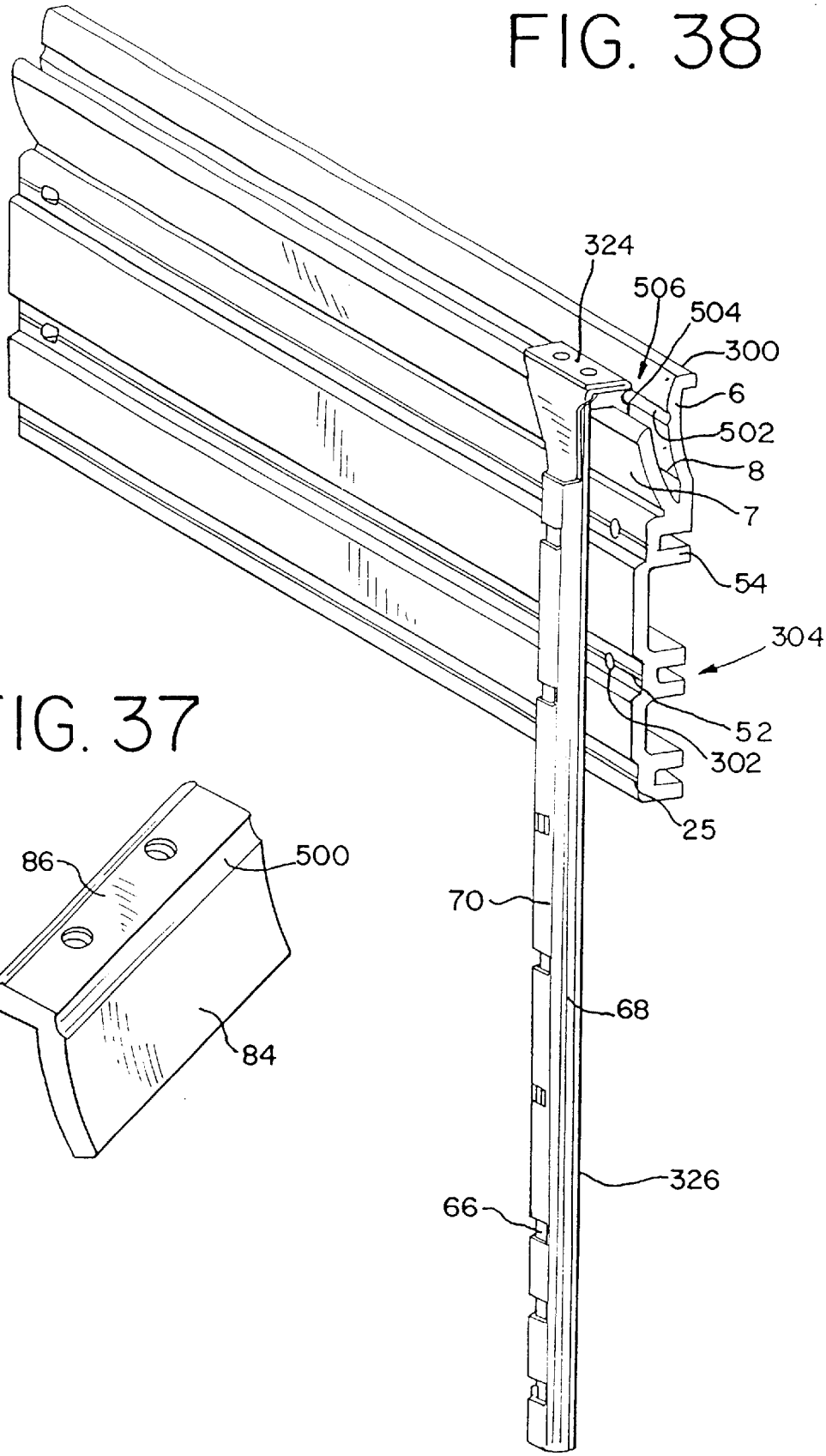
FIG. 38 is a perspective of view of a connector member and insert member installed on a rail member with an anti-dislodgment pin.

The connector portion 64 of the support member includes a web 68 extending laterally from the base portion 66 and a plurality of flanges 70 extending from the web to form a series of channels along the length of the connector portion. The connector portion channel is attached to an end of a work station component, such as an overhead storage cabinet. For example, as shown in the alternative embodiment of FIGS. 31–33, an end wall 316 of an overhead end panel 318 is received in the channel and is secured to the flange with a snap-fit configuration. Alternatively, fasteners and the like can be used to secure the connector portion to the end panel. A pair of openings 328 are formed in the base portion 66 and are positioned to secure a pair of cross-braces 320 that extend from one connector member to another, as shown in FIG. 36. The end panels 318 further support a shelf 322. If desired, a flipper door assembly (not shown) can be installed so as to form an overhead cabinet with the end panels and shelf. In an alternative embodiment, the end panels can be configured with a standard bracket that engages the slots in the vertical frame member.

Figure 16:
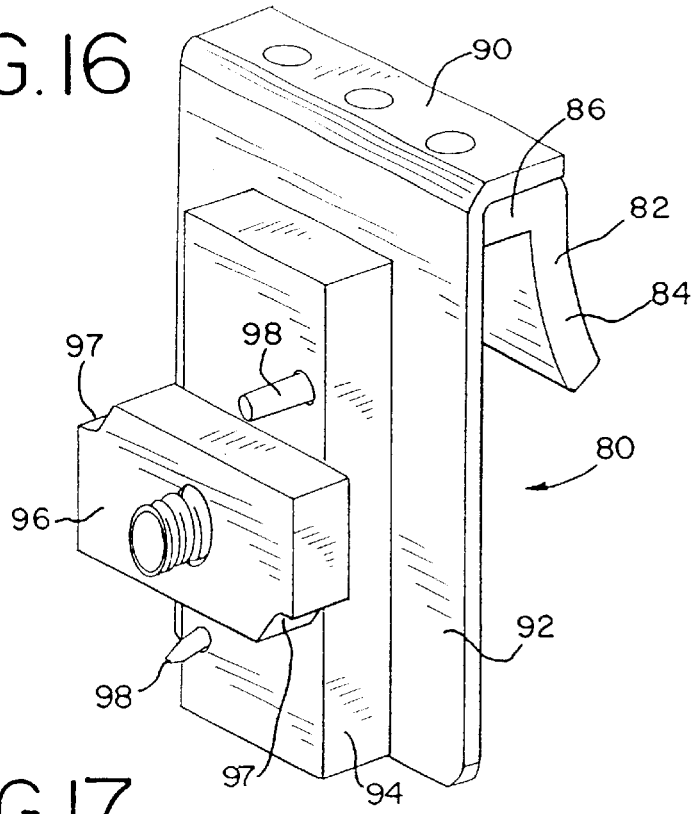
FIG. 16 is a perspective view of an alternative embodiment of a support member.
Figure 28:
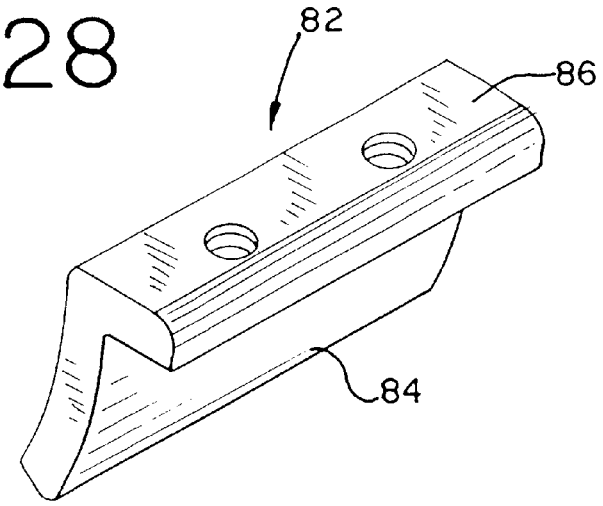
FIG. 28 is a perspective view of an insert member.

In an alternative embodiment, shown in FIGS. 5, 6 and 16, an upper support member 80 is configured to engage a return panel 20. In this embodiment, the support member includes an insert member 82, best shown in FIG. 28, having a curved flange 84 dimensioned to be received in the channel 8 and a horizontally extending mounting flange 86 having a pair of holes. An L-shaped connector member 88 includes a horizontal mounting flange 90 that is attached to the mounting flange 86 of the insert member with fasteners, or by welding and the like. A vertically extending connector flange 92 includes an alignment block 94 mounted thereon. The block 94 is dimensioned to be received in the channel 116 formed in the vertical frame member along the end of the return panel, and further to extend into an opening formed in the end of the vertical frame member in the base of the channel.

A cam member 96 is rotatably mounted to the block 94 about a horizontal axis of rotation, and includes a pair of shoulders 97 at opposite corners of the cam member. A pair of stop members 98 extends laterally from the block 94 and is positioned to engage the shoulders 97 of the cam member 96 when it is rotated to a disengaged position. The support member, with the cam member, is attached to work station component to the wall panel. For example the cam member 96 can be positioned to be aligned with and extend into the opening 130 formed in the end of a vertical frame member of a return panel as shown in FIG. 5. The return panel has the same construction as the wall panel.

Once the cam member 96 is disposed through the opening, the installer rotates the cam member 96 from a vertically oriented disengaged position to a horizontally oriented engaged position, as explained in more detail below. A backside of the cam member 96 engages the inner surface of the vertical frame when the cam member is in the engaged position so as to releasably secure the return panel, or other work station component, to the support member.

Figure 33:
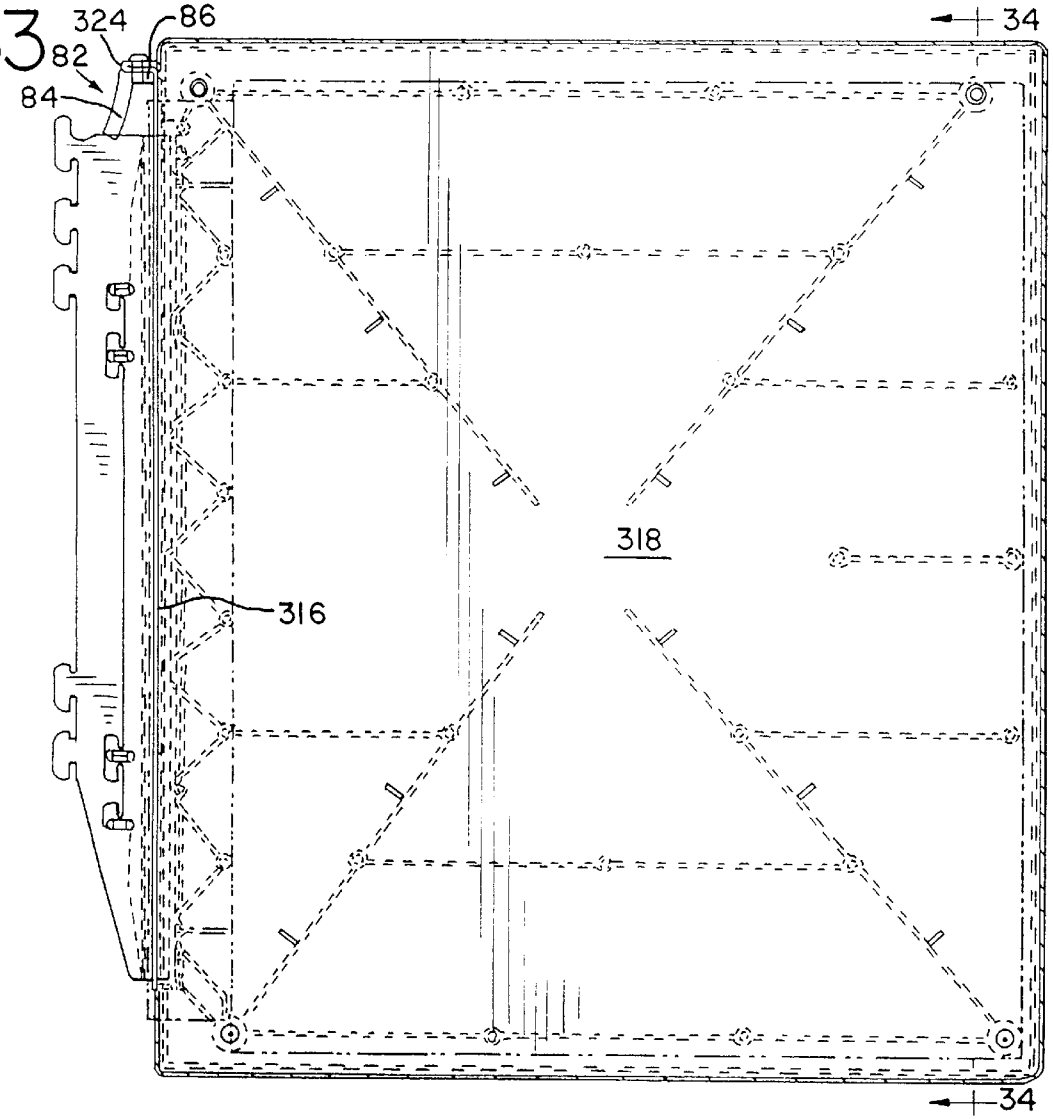
FIG. 33 is a side view of an overhead end panel.

In an alternative embodiment, shown in FIG. 33, the insert member 82 is attached beneath a flange 324 extending laterally from the top of the base portion 66 of the connector 326. The flange 324 is formed by folding the flange back on itself. The flange 324 of the connector member is attached to the flange 86 with a pair of fasteners. Preferably, the connector is first attached to the end panel 318, or other component, and is thereafter moved into position over the insert member 82 and attached thereto with the fasteners.

Figure 37:
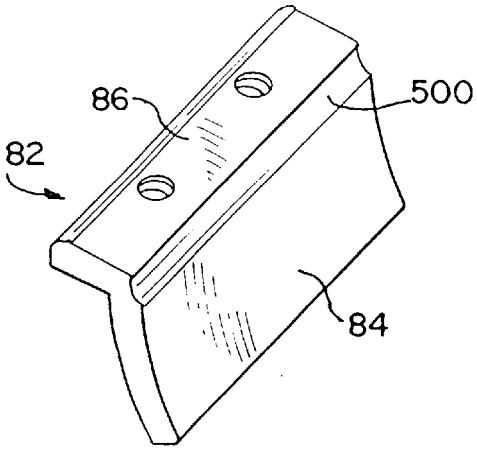
FIG. 37 is a perspective view of an alternative embodiment of an insert member.

In yet another alternative embodiment, best shown in FIGS. 36 and 37, the insert member 82 further includes a groove or channel 500 formed along its length at the corner at the junction between the flanges 84 and the flange 86. The rail member includes a groove or channel 502 formed along the length of the wall 6. As shown in FIG. 37, the groove on the insert member mates with the opposite facing groove on the wall so as to form a cylindrical passageway 506. An anti-dislodgement pin 504 is inserted into the passageway 506 so as to prevent the insert member 82 from being vertically displaced, or removed from the rail member channel 8. It should be understood that the pin 504 does not prevent the support member, and the insert member in particular, from being moved horizontally along the length of the channel 8, if desired. It also should be understood that any of the above-described insert members and insert portions, along with the rail members, can be configured with grooves to form a passageway shaped to receive a pin when mated. Although the passageway has been shown as cylindrical, it should be understood that other shapes, including a rectangular cross-sectional opening, would also work.

Figure 15:
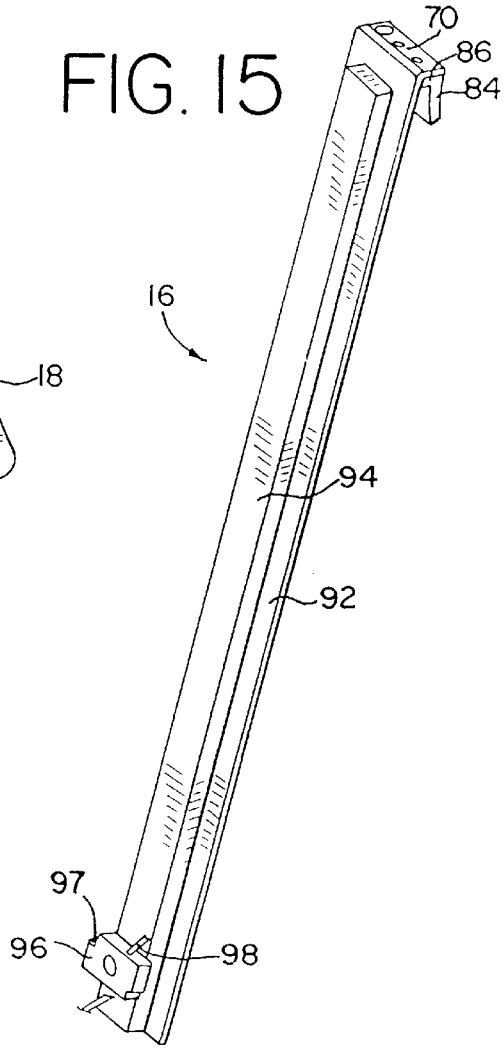
FIG. 15 is a perspective view of an alternative embodiment of a support member.

In yet another embodiment of the support member, shown in FIGS. 5 and 15, the connector member and block member are elongated to form a change-of-height (COH) connector 16, which extends down to and accommodates a shorter return wall panel being attached to a taller base wall panel. Other than their length or size, the components for the COH support member are of the same type of construction as the support member 80, and the same reference numbers are therefore used to identify like components.

Figure 25:
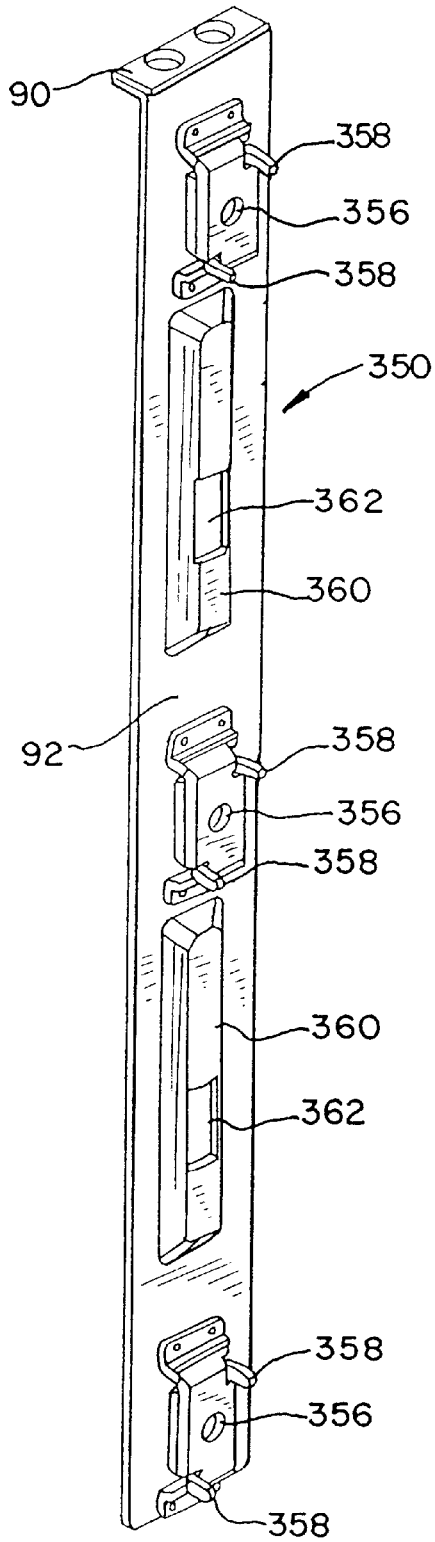
FIG. 25 is a front perspective view of an alternative embodiment of a support member.

In yet another embodiment of the support member, shown in FIG. 25, the connector member 350 is elongated and includes three support platforms 352 spaced longitudinally along the length of the connector member and attached thereto with fasteners, such as rivets, or by welding and the like. Each support platform 352 includes a support surface 354 having an opening 356 formed therein that is aligned with an opening formed in the connector member. Each support platform further includes a pair of stop members 358 extending laterally from opposite diagonal corners thereof. The connector member further includes raised portions 360, or stiffening ribs formed therein for added rigidity and strength. Each raised portion has an opening 362 formed therein. The opening 362 is shaped to receive a tab member that extends from the vertical frame member along the end of the wall panel. In this way, the tab member does not interfere with the installation of the connector member on the return panel as the rib portion is received in the outwardly facing channel 105 formed along the length of the vertical frame member 102. Although the connector member is shown in FIG. 25 with three support platforms, it should be understood that it could also be configured with any other number of such platforms as desired.

In one preferred embodiment, a cam member 96 is rotatably mounted to each support platform as needed to secure the connector member to a return panel or other component. For example, the cam member can be secured to one of the three support platforms as needed to accommodate return panels of various heights. Or, a plurality of cam members can be used to secure a single component. Preferably, the cam member 96 is mounted with a fastener, such as a screw, that extends from the back side of the connector member through web 92, through the opening 356 and threadably engages the cam member 96.

During installation, the installer can slide the support member 14, 80, 16 to any position along the length of the rail member 2, thereby providing the user with infinite off-module adjustment capability for the various office system, or work station components. It should be understood that the term "component" means any office system item that is attached to or supported on a wall panel, including for example, but not limited to, return panels, overhead storage units, shelving, worksurface members, various support brackets and various tools, including for example paper trays and the like.

Figure 8:
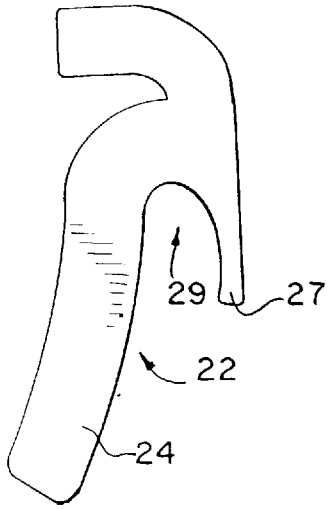
FIG. 8 is a side view of a channel cover member.

Referring to FIG. 5, the portions of the channel 8 remaining open between the various support members 14, 16, 80 that are inserted therein can be covered with a channel cover member 22, best shown in FIGS. 5 and 8. The cover member includes a curved insert portion 24 that is shaped to be received in the channel, and a horizontal and vertical flange 26, 28. The vertical flange 28 forms a channel 29 with the insert portion 24 that is shaped to receive the upper edge 62 of the outer wall 7. The bottom edge 27 of the vertical flange is disposed adjacent the top edge of the cover tile 4 so as to provide a pleasing aesthetic appearance. The horizontal flange 26 extends inwardly to abut an upper portion of the inner wall. The cover member 22 can be made of plastic, wood or metal, and is preferably formed as an extrusion.

Figure 26:
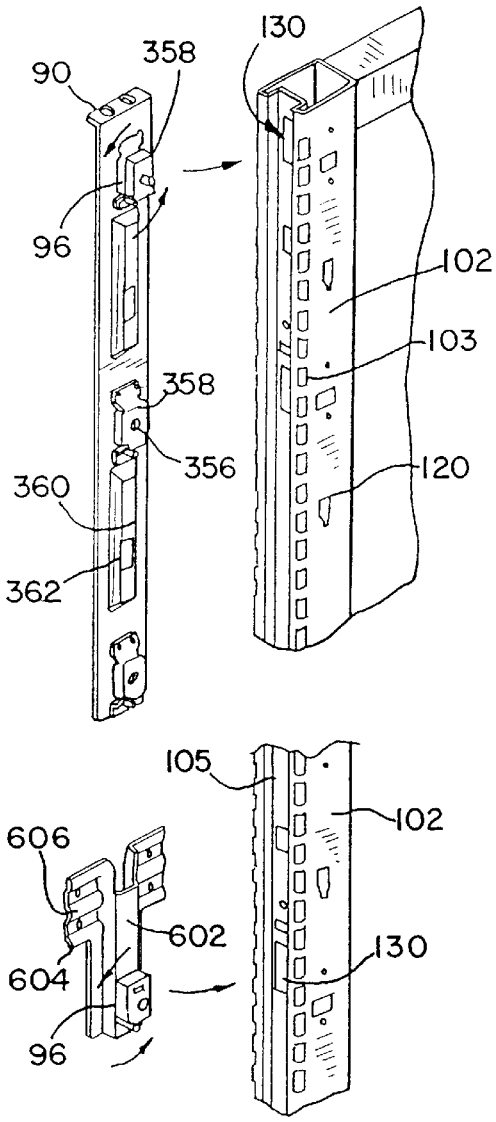
FIG. 26 is a partial exploded perspective view of a connector member and a support member being secured to the end of a return panel.
Figure 27:
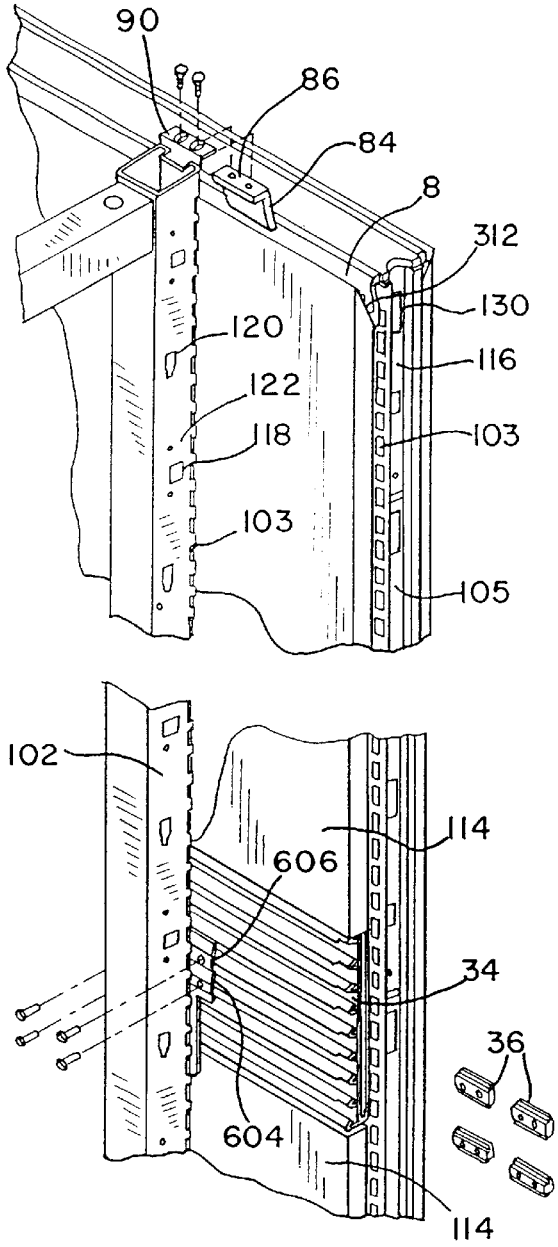
FIG. 27 is a partial exploded perspective view of a return panel being secured to a wall panel with a support member and a connector member.

In a preferred sequence of installation, best illustrated in FIGS. 26 and 27, the connector member 350, 80 is first attached to the return panel, or other component. In particular, the cam members 96 are first loosened so as to be spaced from the connector member or support platform by unscrewing the fastener threadably engaged with the cam member as it engages the stop members. The connector member is then positioned at the end of the return panel such that the cam member extends through the opening 130. The fastener is then tightened so as to both rotate the cam member 96 and also to draw it towards the connector member wherein the frame member 102 is clamped between the cam member 96 and the connector member. The cam member 96 engages the inner walls of the frame member to prevent the cam member from spinning inside the frame member and thereby allow it to be drawn towards the connector member. This operation is repeated for each cam member along the length of the connector member. It should be understood that only one cam member is required to secure the connector to the component.

Once the connector member is securely attached to the return panel, or other component, the return panel is positioned adjacent the wall panel such that flange 90 is disposed above the flange 86 of the insert member 82, which is positioned at a desired position along the length of the rail member and engaged therewith as described above, and preferably with an anti-dislodgment pin. The connector member is then secured to the insert member to complete the installation.

Figure 9:
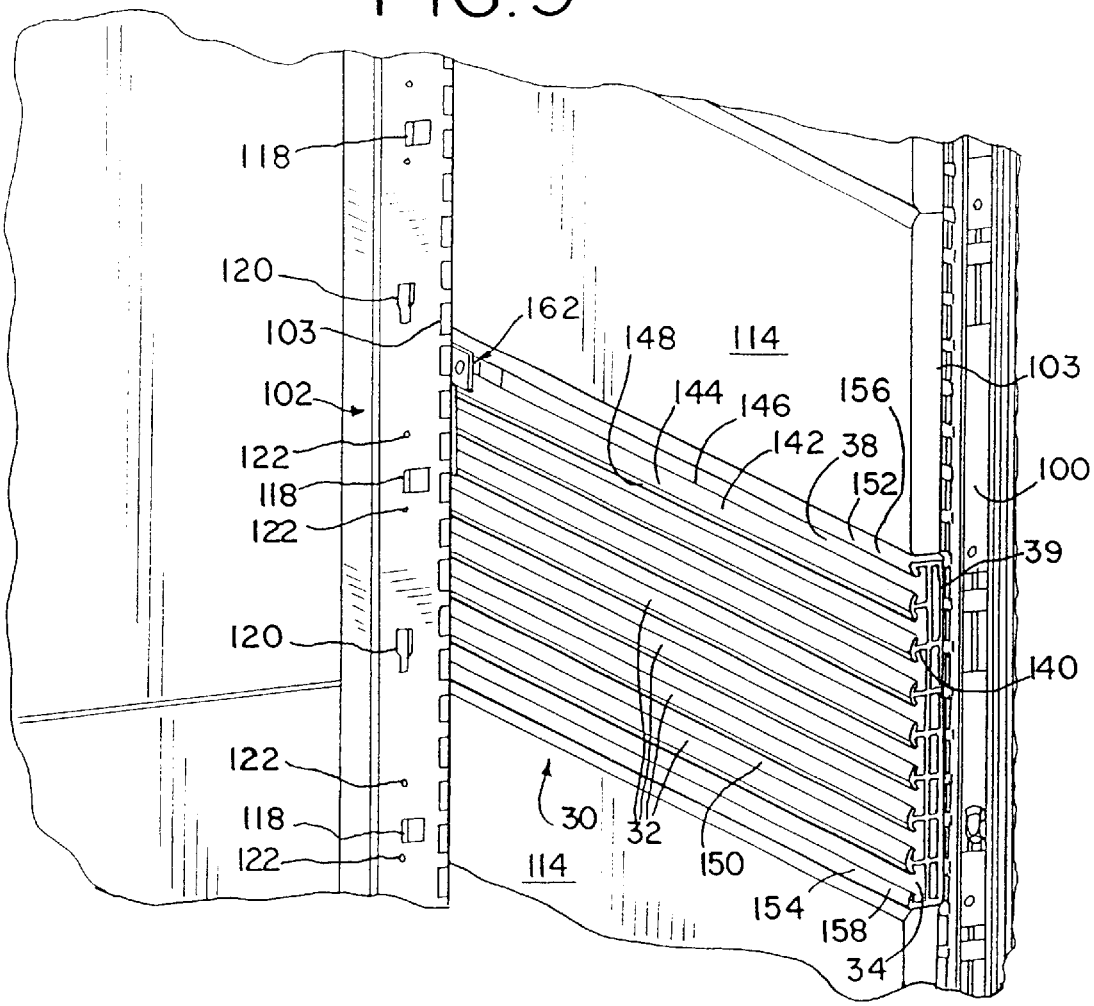
FIG. 9 is a partial perspective view of a connector tile attached to a wall panel frame, with a return panel connected to the connector tile.
Figure 11:
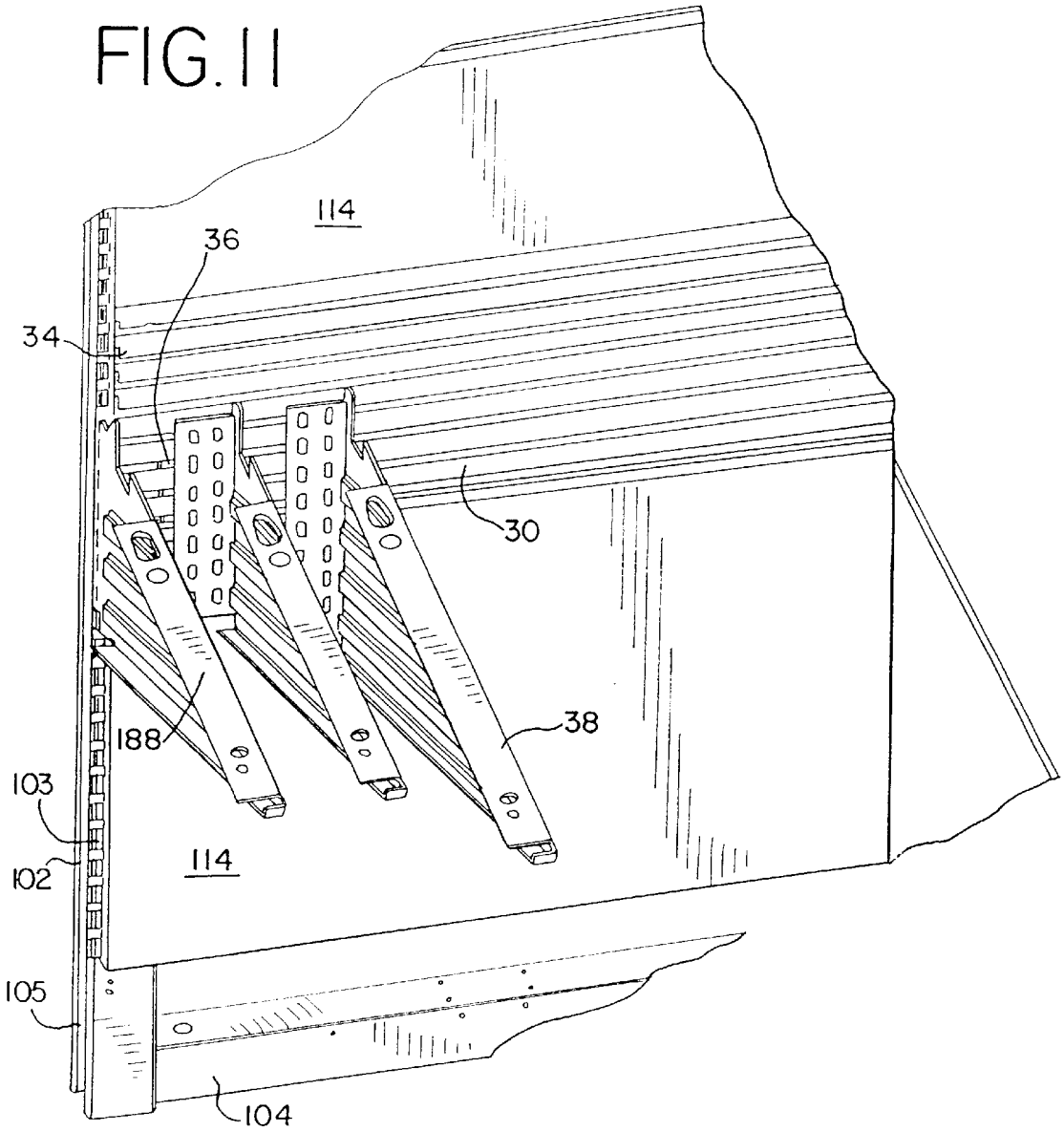
FIG. 11 is a partial perspective view of a plurality of support brackets supported on a connector tile.
Figure 17:
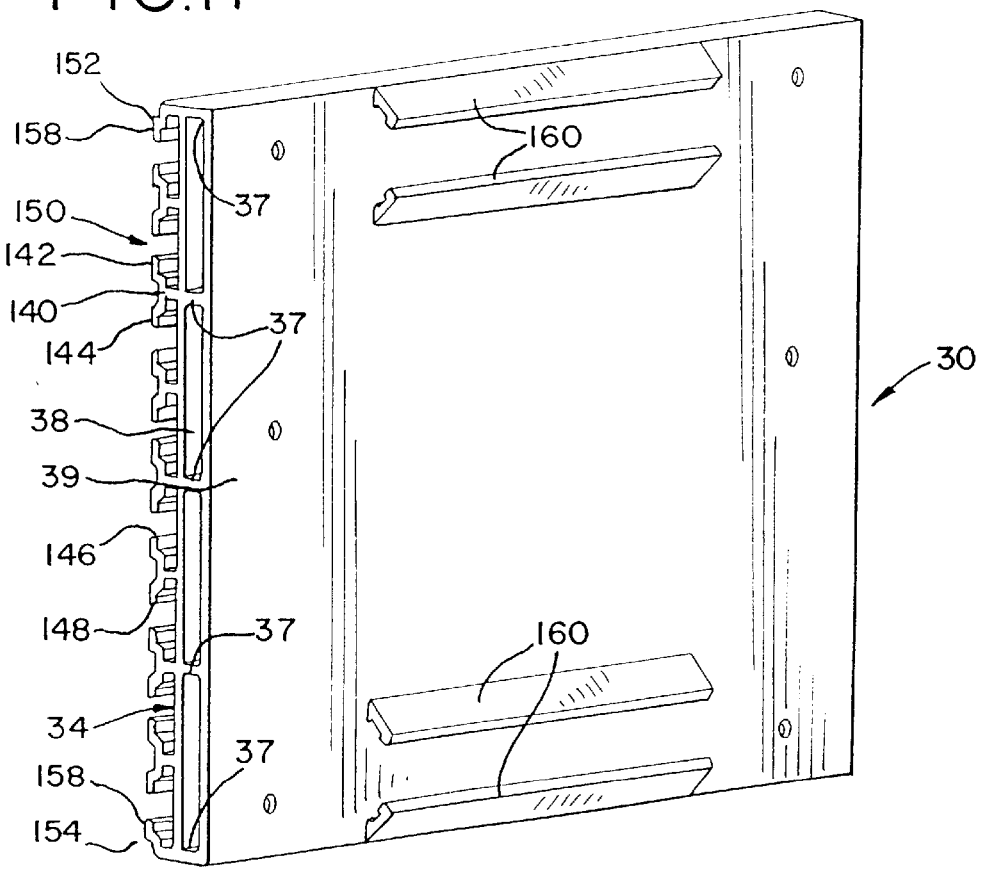
FIG. 17 is a rear perspective view of a connector tile.

In another aspect of the off-module components, best shown in FIGS. 9, 11 and 17, a connector tile 30 is attached to the panel frame. The connector tile 30 is preferably the same size as the cover tile 114. In this way, the wall panel can be reconfigured for off-module support by removing one or more cover tiles 114, and removably attaching in their place one or more connector tiles 30. Preferably, the connector tile 30 is removeably attached to the vertical frame members 102 with a plurality of fasteners, such as screws. Alternatively, the connector tile can be fixedly attached to the frame with clips and hooks, or by welding or the like. It should be understood that the rail member and one or more connector tiles can be attached to one or both sides of the frame as needed for off-module attachment.

Figure 23:
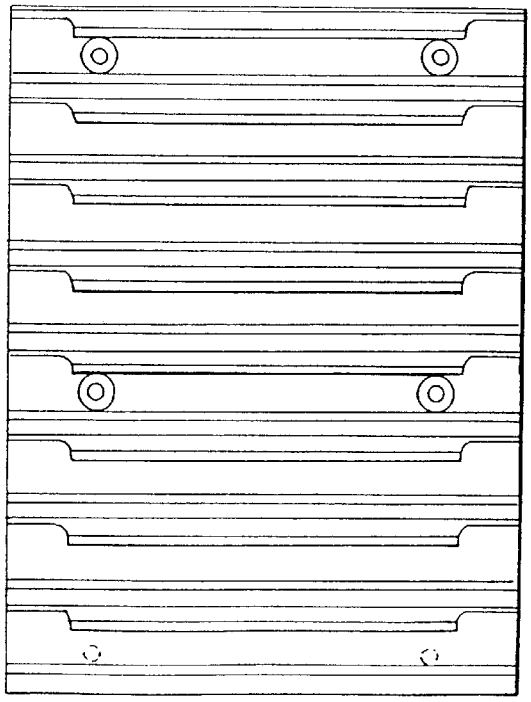
FIG. 23 is a front view of an alternative embodiment of a connector tile.

The connector tile 30 includes a plurality of horizontal T-shaped members 32 extending laterally from an outer side wall 38. The connector tile further includes an inner side wall 39 laterally spaced from said outer wall and connected thereto with spaced webs 37 to form a plurality of box-beams. The T-shaped members 32 each include a base wall 140, a wall 142 extending upwardly from the base wall and terminating in a top edge 146 and a wall 144 extending downwardly from the base wall and terminating in a bottom edge 148. The top edge 146 of the upwardly extending wall 142 of a lower T-shaped member and the bottom edge 148 of the downwardly extending wall 144 of an upper T-shaped member are spaced apart to form an opening 150 therebetween. The walls 140, 142, 144, 38 form T-shaped channels 34 therebetween. An upper and lower L-shaped member 152, 154 run along the top and bottom of the tile and include a downwardly and upwardly extending wall 156, 158 respectively. In a preferred embodiment, shown in FIG. 23, the end portions of the downwardly extending walls are cut away so as to provide additional access to the channels.

The connector tile 30 is preferably made of metal and is formed by extrusion. In the embodiment shown in FIG. 17, two pairs of horizontally elongated flanges 160 extend from the inner wall 39 of the connector tile. Each pair includes an upper and lower flange angled toward each other. The flanges are configured to capture a piece of angle iron that provides increased strength and rigidity to the connector tile.

Figure 10:
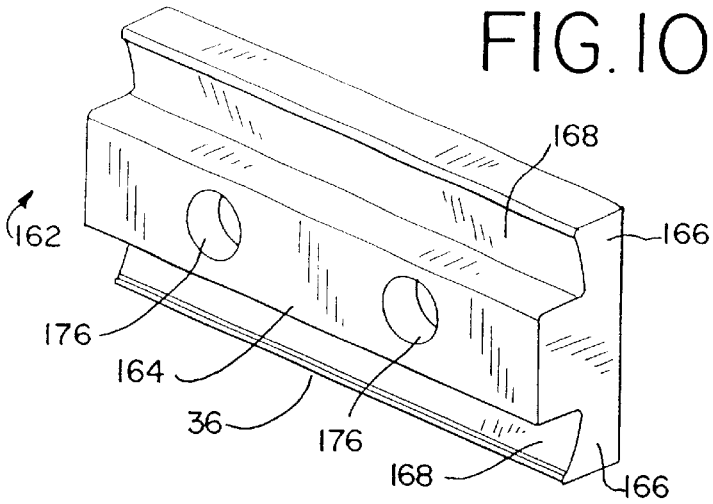
FIG. 10 is a perspective view of a support block.
Figure 12:
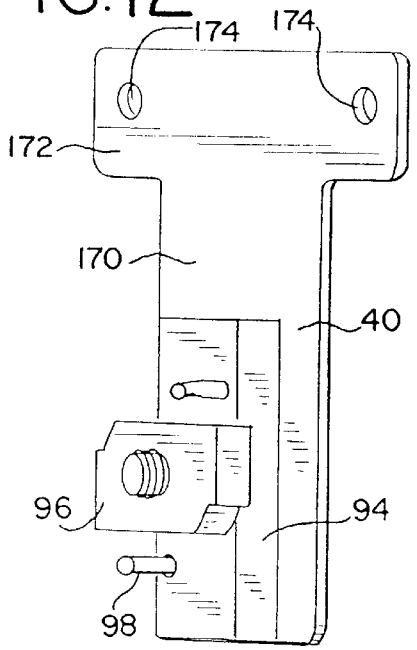
FIG. 12 is a perspective view of a connector member.
Figure 13:
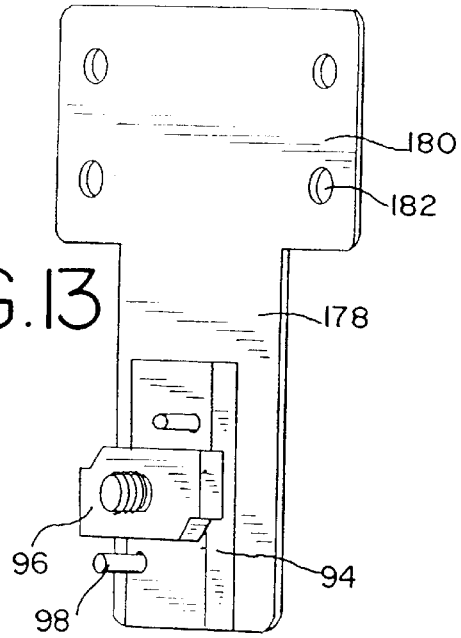
FIG. 13 is a perspective view of an alternative embodiment of a connector member.
Figure 14:
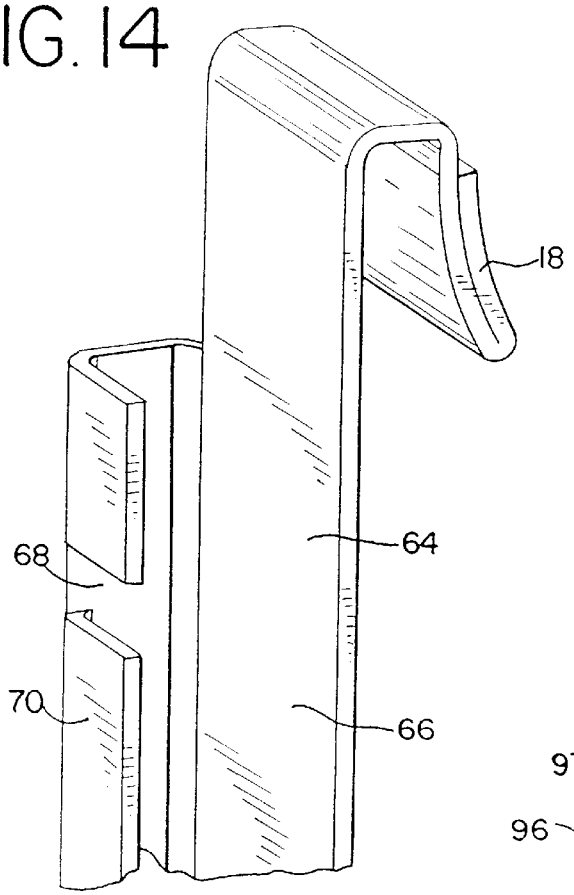
FIG. 14 is a partial perspective view of an upper portion of the support member shown in FIG. 7.

A lower support member 162 includes a T-shaped support block 36, or insert member, best shown in FIG. 10, and a connector bracket 40, best shown in FIGS. 12 and 13. The support block 36 has a middle portion 164 and a pair of wing portions 166 or insert portions, extending therefrom to form a cross-section shaped to mate with the channel 34 formed on the connector tile. Preferably, the wing portions 166 have an outermost surface 168 that is curved or angled to engage the correspondingly shaped walls 142, 144 on the connector tile 30. The support block 36 is slid into the T-shaped channel, with an upper wing portion 166 of the support block engaging the downwardly extending wall 144 of an upper T-shaped member 32 and with a lower wing portion 166 of the block engaging an upwardly extending wall 142 of a lower T-shaped member 32. The middle portion 164 of the support block extends through the opening 150 formed between the two walls 142, 144 and has a plurality of threaded holes 176.

Figure 29:
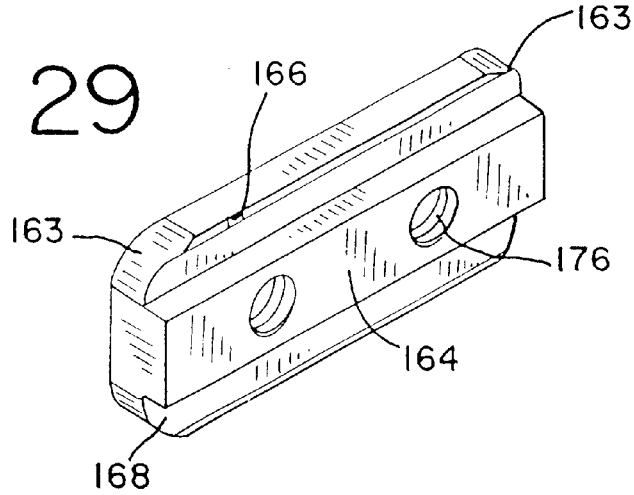
FIG. 29 is a perspective view of an alternative embodiment of a lower support member.

In an alternative embodiment of the support block, shown in FIG. 29, the corners 163 of the support block are curved so as to facilitate the insertion of the block in to the channel 34.

If the support block 36 is inserted into the uppermost or lowermost T-shaped channel 34, the upper or lower wing portion, respectively, of the support block will engage one of the walls 156, 158 of the upper or lower L-shaped member 152, 154. The support block is preferably made of metal. The support blocks, which must be slid into the channels 34 from the end of the connector tile, cannot be laterally removed from the connector tile and act as an anti-dislodgment member once they are connected to a work station component.

Referring to FIG. 12, the connector bracket 40 includes a T-shaped plate member 170 having an alignment block 94 attached thereto, or formed therein by stamping or the like. A cam member 96 is rotatably attached to the alignment block 94 and a pair of stop members 98 extend laterally from the block 94 to stop the rotation of the cam member 96 at a disengaged position. An upper portion 172 of the plate member includes a plurality of horizontally spaced fastener holes 174 spaced to mate with the holes 176 disposed in the support block. A plurality of fasteners is installed to attach the connector member to the support block.

Referring to FIG. 13, an alternative embodiment of the plate member 178 includes a plurality of horizontally spaced and vertically spaced openings 182 formed in an upper portion 180 that are positioned to be aligned with the openings 176 in a pair of support blocks inserted in a connector tile and positioned one over the other. This double attachment provides additional strength and security.

Figure 24:
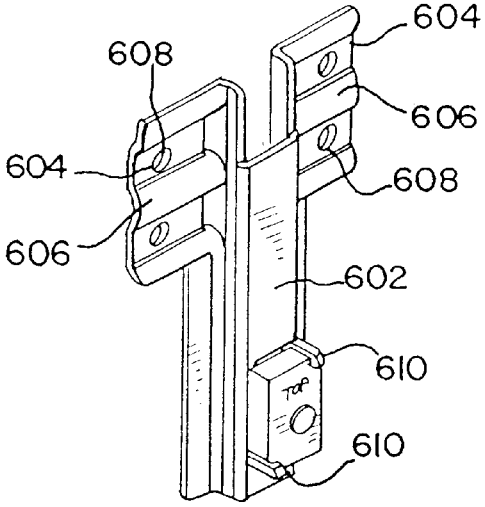
FIG. 24 is a front perspective view of an alternative embodiment of a connector member.

In yet another alternative embodiment of the connector bracket, best shown in FIGS. 24, 26 and 27, the connector bracket 600 is preferably T-shaped, and has a longitudinally extending hat section 602 that is shaped to be received in the end of the return panel. A pair of wing portions 604 each have a curved portion 606, which form recesses that are shaped to mate with the outermost surface of the T-shaped members 32 of the connector tile. The curved portions also provide additional strength for the bracket. The wing portions 604 each include a pair of holes 608 for receiving a fastener or the like.

The bracket 600 is preferably made as a stamping. A pair of stop members 610 extend laterally from a lower portion of the hat section. A cam member 96 is rotatably mounted to the connector bracket with a fastener that extends through the hat section and threadably engages the cam member. The stop members 610 engage the cam member when it is in the disengaged position so as to allow it to be loosened.

Once installed, the lower support member 162 can be positioned to engage an office system component, such as the return panel shown in FIG. 9. The return panel can be attached to both the rail member and the connector tile using the cam members 96 of the upper and lower support members respectively, as shown for example in FIGS. 26 and 27. Again, the lower support member 162, and the support block in particular, along with any components attached thereto, can be slid in the channels 34 of the connector tile along the length thereof to provide infinite off-module support locations for the components. Preferably, the connector bracket 600 is first attached to the return panel, or other component, as explained above. The return panel is then placed adjacent the wall panel. The wing portions 604 extend laterally from each side of the return panel frame such that the holes 608 therein can be accessed by the installer. Fasteners are then installed to secure the connector bracket 600 to the support block 36 to complete the installation.

Figure 30:
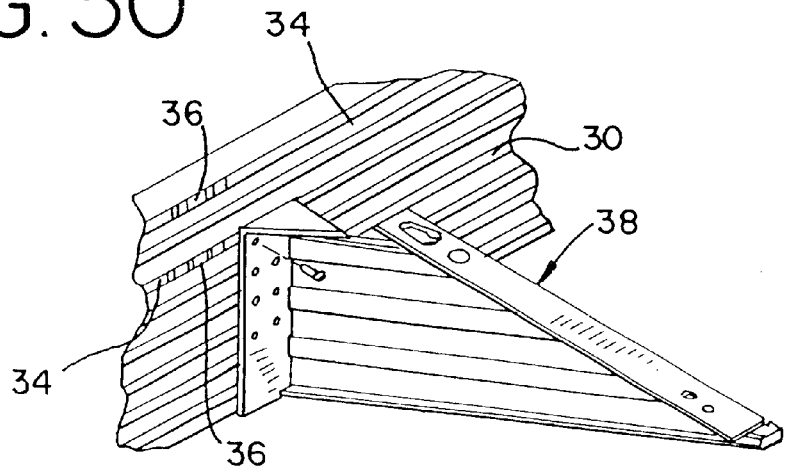
FIG. 30 is a perspective view of an alternative embodiment of a support bracket supported on a connector tile.

Alternatively, as shown in FIGS. 11 and 30, the support member can be comprised solely of the support block 36, one or more of which can be positioned in the channels 34 and of the connector tile and can be fastened to a work station component such as the work-surface support bracket 38 shown in FIGS. 11 and 30. In particular, one support bracket 188 is engaged in the slots of the vertical frame member, while the other support bracket 38 are bolted directly to one or more vertically disposed support blocks 36 inserted into the channels 34 of the connector tile 30, without the need for the connector bracket. Alternatively, the support brackets can be configured with hook members that engage one or more of the walls of the connector tile, or they may be provided with integrally formed blocks that can be inserted into the channels.

Figure 35:
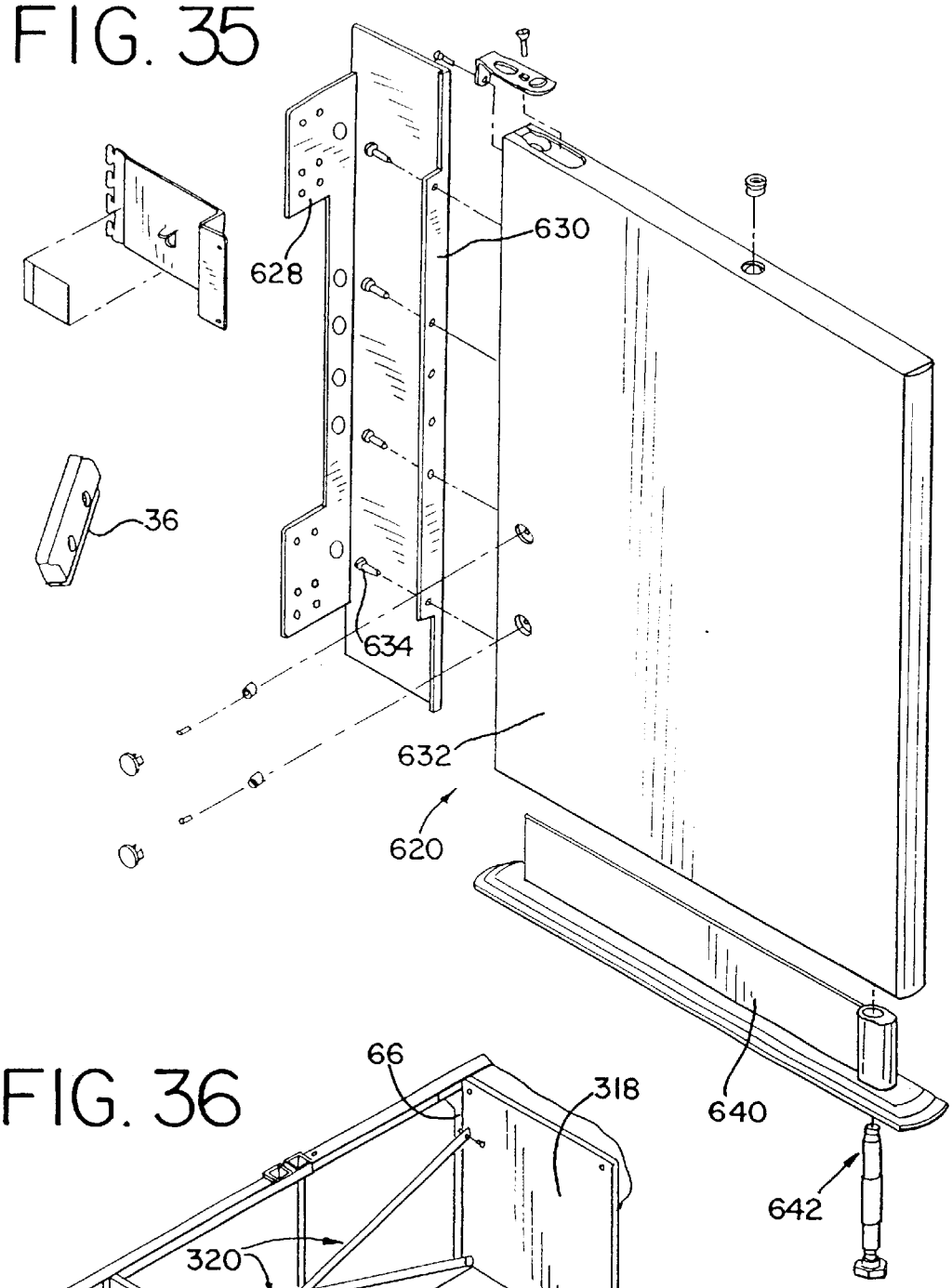
FIG. 35 is an exploded perspective view of a work surface support assembly.

Finally, as best shown in FIG. 35, a work surface support 620 also can be connected off-module. In the assembly, a connector bracket 622 is configured as a channel 624 having a base web 626 and opposite mounting flanges 628, 630. A first flange 628 is connected to one or more support blocks 36 engaged with a connector tile 30, and preferably two support blocks positioned adjacent the top of the connector bracket 622, as explained above. The opposite second flange 630 is connected to the end of the work surface support panel 632, preferably with a plurality of fasteners 634. It should be understood by one of skill in the art that the connector bracket could be formed integrally as part of the support panel, or that the support panel could comprise a mounting flange having openings aligned with various support blocks. The support panel further comprises a bottom portion 640 and a leg 642 that supports the outboard end of the panel.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

We claim:

1. A wall panel assembly comprising:

a wall panel comprising first and second upwardly extending, curvilinear walls, said first and second walls spaced apart to form an upwardly opening channel, wherein said first and second walls each have a top and a bottom and wherein said first and second walls are curvilinear along at least a portion thereof between said top and said bottom of each of said first and second walls;

a support member having a downwardly extending, curvilinear insert portion, said insert portion inserted in said channel formed by said first and second walls; and a component attached to said support member.

2. The invention of claim 1 wherein said wall panel further comprises a frame having a first and second side, and a rail member connected to said first side of said frame, said rail member comprising said first and second walls, wherein said first and second walls are laterally, outwardly offset from said first side of said frame.

3. The invention of claim 2 wherein said frame comprises a pair of vertical frame members disposed along each end of said wall panel and a pair of horizontal frame members extending between and connected with said vertical frame members.

4. The invention of claim 3 wherein said rail is attached to said vertical frame members.

5. The invention of claim 2 wherein said rail is removeably attached to said frame.

6. The invention of claim 2 further comprising a second rail attached to said second side of said frame.

7. The invention of claim 1 wherein said first wall is longer than said second wall and has a greater upward extent than said second wall.

8. The invention of claim 1 wherein said support member is integrally formed with said component.

9. The invention of claim 1 wherein said wall panel further comprises a tile covering at least a portion of at least one of said walls such that said portion is not visible to a user when viewing the wall panel from a side thereof.

10. The invention of claim 9 wherein said wall panel further comprises a frame, wherein said tile is removeably attached to said frame.

11. The invention of claim 1 wherein wall panel further comprises a third, downwardly extending wall having a bottom edge and a fourth, upwardly extending wall having a top edge, wherein said third wall is disposed above said fourth wall with said bottom and top edges respectively of said third and fourth walls spaced apart to form an opening therebetween, and wherein said support member comprises a first support member, and further comprising a second support member, said second support member comprising an insert portion abuttingly engaging at least one of said third and fourth walls, and wherein said component is further attached to said second support member.

12. The invention of claim 11 wherein said third and fourth walls are spaced laterally outward from a side wall, wherein said third, fourth and side walls form a T-shaped channel, and wherein said second support member comprises a middle portion and a pair of wing portions extending therefrom, said wing portions forming said insert portion and dimensional to be received in said T-shaped channel and abuttingly engaging said third and fourth walls, and said middle portion being exposed for access by a user through said opening formed between said bottom and top edges of said third and fourth walls respectively.

13. The invention of claim 11 wherein said wall panel further comprises a frame and a connector tile removeably attached to said frame, wherein said connector tile comprises said third and fourth walls.

14. The invention of claim 13 wherein said connector tile further comprises a plurality of T-shaped members forming said third and fourth walls, wherein each of said plurality of T-shaped members are disposed vertically one above the other.

15. The invention of claim 1 wherein said component comprises a return wall panel.

16. The invention of claim 1 wherein said component comprises an overhead cabinet.

17. The invention of claim 1 wherein said first and second walls run substantially along an entire length of the wall panel, and wherein said channel runs continuous substantially along said entire length.

18. The invention of claim 1 wherein said insert portion and said first wall form a passageway therebetween, and further comprising a pin inserted into said passageway.

19. A wall panel assembly comprising:

a wall panel having an elongated, horizontally oriented channel, said channel having an curved interior space accessible from a top of the channel, wherein said channel also has a bottom, and wherein at least a portion of said interior space is curved between said top and said bottom of said channel;

a support member having a downwardly extending insert portion, said insert portion inserted in said curved interior space; and a component attached to said support member.

20. The invention of claim 19 wherein said channel comprises a first and second wall defining said curved interior space.

21. The invention of claim 20 wherein said first wall is laterally offset from said second wall.

22. The invention of claim 19 wherein said wall panel comprises a frame having a first and second side, and a rail member attached to said first side of said wall panel, wherein said rail member comprises said channel.

23. The invention of claim 22 further comprising a connector tile attached to said first side of said frame, said connector tile having a plurality of horizontally extending channels disposed vertically one above the other, and a second support member engaged with at least one of said channels.

24. The invention of claim 23 wherein each of said plurality of channels of said connector tile is T-shaped.

25. A wall panel assembly comprising:

a wall panel comprising a frame having a first and second side;

a rail member removeably attached to a first side of said frame, said rail member comprising an horizontally extending, upwardly opening channel;

a connector tile removeably attached to a first side of said frame in a vertically spaced relationship with said rail member, said connector tile comprising a plurality of horizontally extending channels disposed vertically one above the other;

a first support member comprising an insert portion moveably disposed in said channel of said rail member, said first support member movable along the horizontal extent of said channel of said rail member;

a second support member comprising an insert portion moveably disposed in at least one of said plurality of channels of said connector tile, said second support member movable along the horizontal extent of said at least one of said plurality of channels of said connector tile;

a component connected to said first and second support members.

26. A wall panel assembly comprising:

a wall panel having at least a first horizontally extending channel;

a first support member engaging the first channel and horizontally moveable therealong, said first support member comprising a rotatable cam member rotatable between at least an engaged position and a disengaged position;

a component having an opening dimensioned to receive said cam member when said cam member is in the disengaged position, said cam member inserted through said opening in said disengaged position, and said cam member engaged with said component when rotated to said engaged position.

27. The invention of claim 26 wherein said component is a return wall panel.

28. The invention of claim 26 wherein said wall panel further comprises a second horizontally extending channel vertically spaced from said first channel on said wall panel and a second support member engaging said second channel, said second support member horizontally moveable along said channel and comprising a rotatable cam member, said cam member on said second support member rotatable between an engaged and disengaged position, and wherein said component further comprises a second opening dimensioned to receive said cam member on said second support member when said cam member is in said disengaged position, and said cam member on said second support member engaging said component when in said engaged position.

* * * * *